US011037479B2

(12) United States Patent
Chae et al.

(10) Patent No.: US 11,037,479 B2
(45) Date of Patent: Jun. 15, 2021

(54) SOURCE DRIVER AND DISPLAY DEVICE INCLUDING THE SAME

(71) Applicant: Samsung Display Co., Ltd., Yongin-si (KR)

(72) Inventors: Se Byung Chae, Yongin-si (KR); Su Bin Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/812,059

(22) Filed: Mar. 6, 2020

(65) Prior Publication Data

US 2020/0286417 A1 Sep. 10, 2020

(30) Foreign Application Priority Data

Mar. 7, 2019 (KR) ..... 10-2019-0026473
Nov. 6, 2019 (KR) ..... 10-2019-0141192

(51) Int. Cl.
*G09G 3/20* (2006.01)

(52) U.S. Cl.
CPC ..... *G09G 3/20* (2013.01); *G09G 2310/0275* (2013.01); *G09G 2310/0289* (2013.01); *G09G 2310/0291* (2013.01); *G09G 2320/0673* (2013.01)

(58) Field of Classification Search
CPC ..... G09G 3/20; G09G 2310/0275; G09G 2310/0289; G09G 2310/0291; G09G 2320/0673
See application file for complete search history.

(56) References Cited

U.S. PATENT DOCUMENTS 8,976,097 B2 3/2015 Lee et al.
9,159,282 B2 10/2015 Kim et al.
2003/0151584 A1* 8/2003 Song ..... G09G 3/3614 345/100
2004/0046724 A1* 3/2004 Woo ..... G09G 3/3688 345/87
2005/0140628 A1* 6/2005 Oh ..... G09G 3/3406 345/89

FOREIGN PATENT DOCUMENTS

KR 10-2013-0044643 A 5/2013
KR 10-2017-0139287 A 12/2017
KR 10-1864834 B1 6/2018

* cited by examiner

*Primary Examiner* — Sejoon Ahn
(74) *Attorney, Agent, or Firm* — Lewis Roca Rothgerber Christie LLP

(57) ABSTRACT

A source driver includes a gamma voltage generator to generate gamma voltages having mutually different voltage levels, a digital-to-analog converter to generate a data voltage corresponding to a grayscale value using the gamma voltages, an output buffer unit to output the data voltage, and a chopping controller to generate a chopping control signal, and to provide the chopping control signal to the output buffer unit. The output buffer unit includes an amplifier connected to an output terminal of the digital-to-analog converter, and a chopping circuit to periodically change a polarity of an offset of the amplifier in response to the chopping control signal. The chopping controller is to change a slew rate of the chopping control signal.

20 Claims, 13 Drawing Sheets

SW: SW1, SW2, SW3, SW4
CCS: CCS1, CCS2, CCS3, CCS4

SOURCE DRIVER AND DISPLAY DEVICE INCLUDING THE SAME

CROSS-REFERENCE TO RELATED APPLICATION

This application claims priority to and the benefit of Korean Patent Application No. 10-2019-0026473, filed on Mar. 7, 2019, and Korean Patent Application No. 10-2019-0141192, filed on Nov. 6, 2019, the content of both of which are incorporated by reference herein in their entirety.

BACKGROUND

1. Field

Aspects of embodiments of the present disclosure relate to a source driver and a display device including the same.

2. Description of the Related Art

A display device includes a display panel and a driver. The display panel includes scan lines, data lines, and pixels. The driver includes a scan driver that sequentially provides scan signals to the scan lines, and a source driver that provides data signals to the data lines. Each of the pixels may emit light at a desired luminance corresponding to a data signal provided through a corresponding data line in response to a scan signal provided through a corresponding scan line.

The source driver generates a data signal corresponding to a grayscale value of image data, and provides the data signal to the data lines through an output buffer. Because an amplifier included in (or configuring) the output buffer has an offset, a quality of an image (e.g., the image displayed in correspondence with the data signal) may be reduced or degraded due to the offset. Therefore, the source driver may include a chopping circuit (or a chopping function) that periodically changes a polarity of the offset of the amplifier.

The above information disclosed in this Background section is for enhancement of understanding of the background of the present disclosure, and therefore, it may contain information that does not constitute prior art.

SUMMARY

An operation of a chopping circuit may cause noise in the data lines, and the noise may affect other configurations, elements, and/or components that are adjacent to the data lines.

One or more example embodiments of the present disclosure are directed to a source driver that is capable of reducing noise generated in the data lines, and a display device including the same.

According to an embodiment of the present disclosure, a source driver includes: a gamma voltage generator configured to generate gamma voltages having mutually different voltage levels; a digital-to-analog converter configured to generate a data voltage corresponding to a grayscale value using the gamma voltages; an output buffer unit configured to output the data voltage; and a chopping controller configured to generate a chopping control signal, and to provide the chopping control signal to the output buffer unit. The output buffer unit includes: an amplifier connected to an output terminal of the digital-to-analog converter; and a chopping circuit configured to periodically change a polarity of an offset of the amplifier in response to the chopping control signal. The chopping controller is configured to change a slew rate of the chopping control signal.

In an embodiment, the chopping circuit may include: a first switch connected between an input node and a first input terminal of the amplifier; a second switch connected between the input node and a second input terminal of the amplifier; a third switch connected between the first input terminal of the amplifier and an output terminal of the amplifier; and a fourth switch connected between the second input terminal of the amplifier and the output terminal of the amplifier. The first to fourth switches may be configured to operate in response to the chopping control signal.

In an embodiment, a parasitic capacitor may be formed between an output node and a control line, the output node being connected to the output terminal of the amplifier, and the control line for transmitting the chopping control signal to the third switch.

In an embodiment, the chopping controller may include: a logic control circuit configured to generate a first control signal including a pulse; a level shifter configured to generate a second control signal by shifting up a level of the first control signal; and a buffer circuit configured to output the second control signal as the chopping control signal, and to change a buffer size.

In an embodiment, the slew rate may correspond to a rate at which the chopping control signal follows the second control signal.

In an embodiment, the buffer circuit may include: sub buffers connected to the chopping circuit in parallel; and sub switches connecting the sub buffers to an output terminal of the level shifter, respectively. At least one of the sub switches may be configured to be turned on in response to a selection signal.

In an embodiment, the sub buffers may have the same buffer size as each other.

In an embodiment, the sub buffers may have mutually different buffer sizes from each other.

In an embodiment, the slew rate of the chopping control signal may be reduced as the buffer size of the buffer circuit is reduced.

In an embodiment, the chopping controller may include: a logic control circuit configured to generate a first control signal having a square wave form; a level shifter configured to generate a second control signal by shifting up a level of the first control signal; a buffer circuit configured to output the second control signal as the chopping control signal; and an analog filter connected between an output terminal of the buffer circuit and the chopping circuit to variably filter a high frequency component of the chopping control signal.

In an embodiment, the analog filter may include: a variable resistor connected between the buffer circuit and the chopping circuit; and a variable capacitor connected between the chopping circuit and a reference voltage line.

In an embodiment, the chopping controller may include: a logic control circuit configured to generate a first control signal having a square wave form; a level shifter configured to generate a second control signal by shifting up a level of the first control signal; a buffer circuit configured to output the second control signal as the chopping control signal; and a delay element connected between an output terminal of the buffer circuit and the chopping circuit.

In an embodiment, the delay element may include: a resistor connected between the buffer circuit and the chopping circuit; and a switch and a diode connected to the resistor in parallel, the switch and the diode being connected to each other in series.

According to an embodiment of the present disclosure, a display device includes: a display panel including a data line, and a pixel connected to the data line; and a source driver configured to provide a data voltage to the data line, the source driver including: a digital-to-analog converter configured to generate a data voltage; an output buffer unit configured to output the data voltage to the data line; and a chopping controller configured to generate a chopping control signal, and to provide the chopping control signal to the output buffer unit. The output buffer unit includes: an amplifier connected between the digital-to-analog converter and the data line; and a chopping circuit configured to periodically change a polarity of an offset of the amplifier in response to the chopping control signal. The chopping controller is configured to change a slew rate of the chopping control signal.

In an embodiment, the chopping circuit may include: a first switch connected between an input node and a first input terminal of the amplifier; a second switch connected between the input node and a second input terminal of the amplifier; a third switch connected between the first input terminal of the amplifier and an output terminal of the amplifier; and a fourth switch connected between the second input terminal of the amplifier and the output terminal of the amplifier. The first to fourth switches may be configured to operate in response to the chopping control signal.

In an embodiment, the chopping controller may include: a logic control circuit configured to generate a first control signal including a pulse; a level shifter configured to generate a second control signal by shifting up a level of the first control signal; and a buffer circuit configured to output the second control signal as the chopping control signal, and to change a buffer size.

In an embodiment, the display device may further include a touch sensing unit including touch electrodes, and the buffer size of the buffer circuit may be controlled according to noise of the touch electrodes due to the chopping control signal.

In an embodiment, the buffer size of the buffer circuit may be reduced as the noise increases.

In an embodiment, the buffer size of the buffer circuit may be set to be largest within a range at which the noise does not occur.

In an embodiment, the buffer circuit may include: sub buffers connected to the chopping circuit in parallel; and sub switches connecting the sub buffers to an output terminal of the level shifter, respectively. At least one of the sub switches may be configured to be turned on in response to a selection signal.

According to one or more embodiments of the present disclosure, the source driver and the display device including the same may reduce noise generated in the data lines and/or in other configurations, elements, and/or components that are adjacent to the data lines by varying the slew rate of the chopping control signal for controlling the chopping circuit that changes (e.g., periodically changes) the polarity of the offset of a source amplifier (e.g., the source amplifier that outputs a data signal).

BRIEF DESCRIPTION OF THE DRAWINGS

The above and other aspects and features of the present invention will become more apparent to those skilled in the art from the following detailed description of the exemplary embodiments thereof with reference to the accompanying drawings, in which.

DETAILED DESCRIPTION OF THE EMBODIMENT

Figure 1:
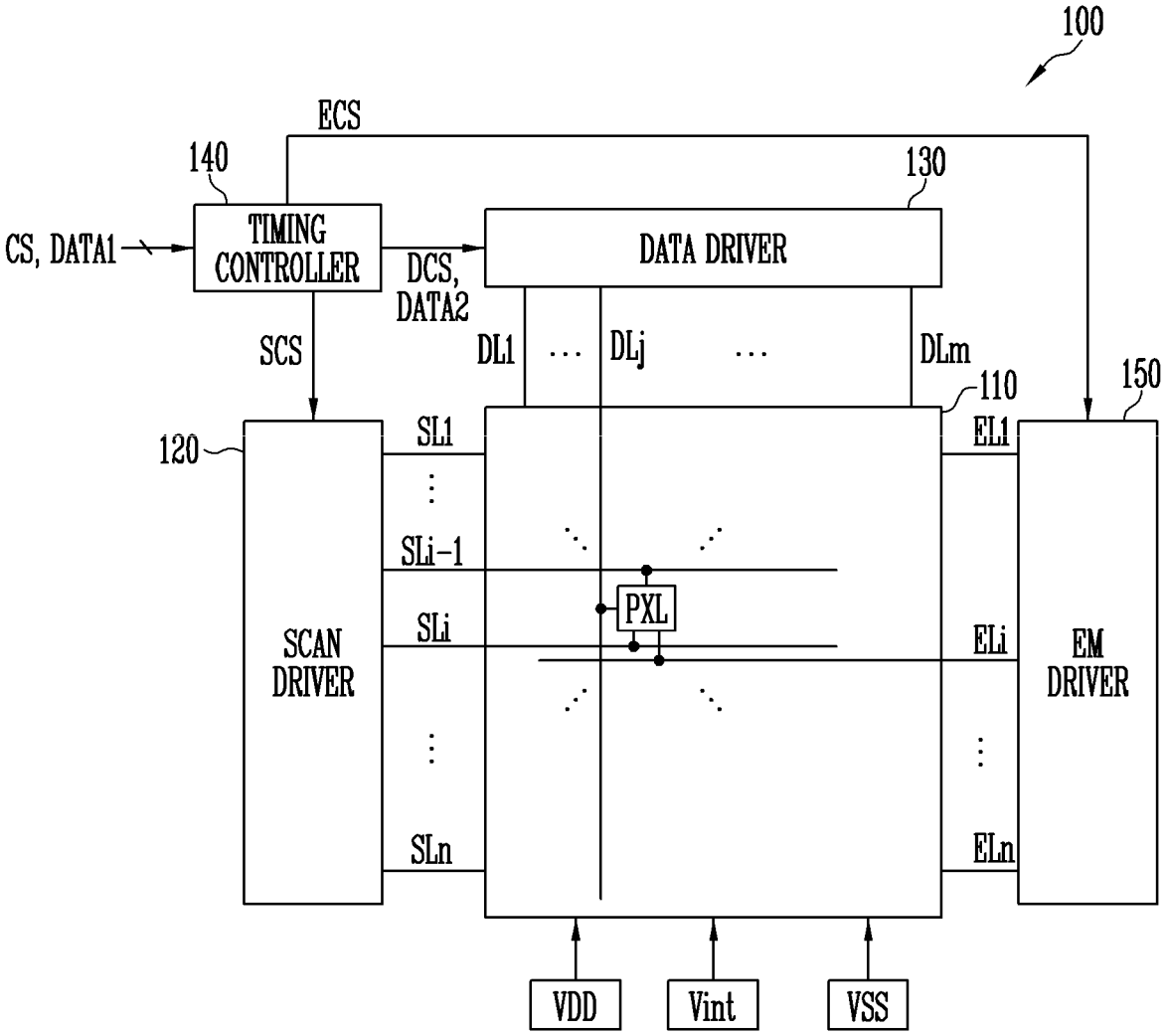
FIG. 1 is a block diagram illustrating a display device according to an embodiment of the disclosure.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to embodiments of the disclosure.

Referring to FIG. 1, the display device 100 may include a display unit (e.g., or a display panel) 110, a scan driver (e.g., or a gate driver) 120, a source driver (e.g., or a data driver) 130, and a timing controller 140. In addition, in some embodiments, the display device 100 may further include a light emission driver (e.g., or an emission driver) 150.

The display unit 110 may include scan lines (e.g., or gate lines) SL1 to SLn (where, n is a positive integer), data lines DL1 to DLm (where, m is a positive integer), light emission control lines EL1 to ELn, and pixels PXL. The pixels PXL may be disposed at (e.g., in or on) an area (for example, a pixel area) that is divided by the scan lines SL1 to SLn, the data lines DL1 to DLm, and the light emission control lines EL1 to ELn. For example, in some embodiments, each of the data lines DL1 to DLm may extend in a first direction (e.g., a column direction), and each of the scan lines SL1 to SLn and the light emission control lines EL1 to ELn may extend in a second direction (e.g., a row direction) that crosses the first direction.

Each of the pixels PXL may be connected to at least one of the scan lines SL1 to SLn, one of the data lines DL1 to DLm, and at least one of the light emission control lines EL1 to ELn. For example, a pixel from among the pixels PXL that is arranged at an i-th row and a j-th column (where i and j are each positive integers) may be connected to an i-th scan line SLi, a previous scan line SLi−1 that is adjacent to the i-th scan line SLi, a j-th data line DLj, and an i-th light emission control line ELi. Hereinafter, for convenience of description, the pixel that is arranged at the i-th row and j-th column may be referred to as the pixel PXL as a representative example of each of the pixels PXL.

The pixel PXL may be initialized in response to a scan signal (e.g., a previous scan signal or a previous gate signal) provided through the previous scan line SLi−1 (e.g., a scan signal or a gate signal provided at a previous time point), may store or record a data signal provided through the data line DLj in response to a scan signal (e.g., a current scan signal or a current gate signal) provided through the scan line SLi (e.g., a scan signal or a gate signal provided at a current time point), and may emit light at (e.g., or having) a luminance corresponding to the stored data signal in response to a light emission control signal provided through the light emission control line ELi.

The display unit 110 may be provided with first and second power voltages VDD and VSS. The first and second power voltages VDD and VSS may be suitable voltages for an operation of the pixel PXL, and the first power voltage VDD may have a voltage level that is greater (or higher) than that of the second power voltage VSS. In addition, the display unit 110 may be provided with an initialization power voltage Vint. The first and second power voltages VDD and VSS and the initialization power voltage Vint may be provided to the display unit 110 from a separate power supply.

The scan driver 120 may generate a scan signal based on a scan control signal SCS, and may provide (e.g., may sequentially provide) the scan signal to the scan lines SL1 to SLn. The scan control signal SCS may include a start signal, one or more clock signals, and/or the like, and may be provided from the timing controller 140. For example, the scan driver 120 may include a shift register (or a stage) that generates and outputs (e.g., sequentially generates and outputs) a scan signal (e.g., of or having a pulse type) corresponding to a start signal (e.g., of or having a pulse type) using the one or more clock signals.

The light emission driver 150 may generate a light emission control signal according to (e.g., or based on) a light emission driving control signal ECS, and may provide (e.g., sequentially provide or concurrently provide) the light emission control signal to the light emission control lines EL1 to ELn. The light emission driving control signal ECS may include a light emission start signal, a light emission clock signal, and/or the like, and may be provided from the timing controller 140. For example, the light emission driver 150 may include a shift register that generates and outputs (e.g., sequentially generates and outputs) a light emission control signal (e.g., of or having a pulse type) corresponding to a light emission start signal (e.g., of or having a pulse type) using the light emission clock signals.

The source driver 130 may generate data signals according to (e.g., or based on) image data DATA2 and a data control signal DCS provided from the timing controller 140, and may provide the data signals to the display unit 110 (or the pixel PXL). The data control signal DCS may be a signal for controlling an operation of the source driver 130, and may include a load signal (e.g., or a data enable signal) for instructing an output of a valid data signal.

In some embodiments, the source driver 130 may output the data signals (or data voltages) to the data lines DL1 to DLm through a plurality of source amplifiers, respectively, and may include a chopping circuit and a chopping controller. The chopping circuit may change (e.g., may periodically change) a polarity of the source amplifiers in response to a chopping control signal. The chopping controller may generate the chopping control signal (e.g., of or having a square wave), and may change (or may vary) a slew rate or a transition speed of the chopping control signal. For example, the slew rate may indicate a rate at which an output signal (e.g., the chopping control signal) follows an input signal, or a change rate of the chopping control signal according to time. The slew rate of the chopping control signal may be controlled (e.g., or set) during a manufacturing process of the display device 100 in consideration of noise generated in the data lines DL1 to DLm by the chopping control signal.

An example configuration of the source driver 130 (and an example configuration of the chopping circuit and the chopping controller) will be described in more detail below with reference to FIGS. 3 to 11.

The timing controller 140 may receive input image data DATA1 and a control signal CS from the outside (for example, from a graphics processor), may generate the scan control signal SCS and the data control signal DCS according to (e.g., or based on) the control signal CS, and may generate the image data DATA2 by converting the input image data DATA1. The control signal CS may include a vertical synchronization signal Vsync, a horizontal synchronization signal Hsync, a clock CLK, and/or the like. For example, the timing controller 140 may convert the input image data DATA1 (e.g., of or having an RGB format) into the image data DATA2 (e.g., of or having an RGBG format) according to (e.g., or corresponding to) a pixel arrangement of the pixels PXL at (e.g., in or on) the display unit 110.

In various embodiments, at least one of the scan driver 120, the source driver 130, the timing controller 140, and the light emission driver 150 may be formed at (e.g., in or on) the display unit 110, or may be implemented as an integrated circuit IC and may be connected to the display unit 110 in a tape carrier package type and/or the like. For example, in some embodiments, at least two of the scan driver 120, the source driver 130, the timing controller 140, and the light emission driver 150 may be implemented on the same IC (e.g., implemented as a single IC).

Figure 2:
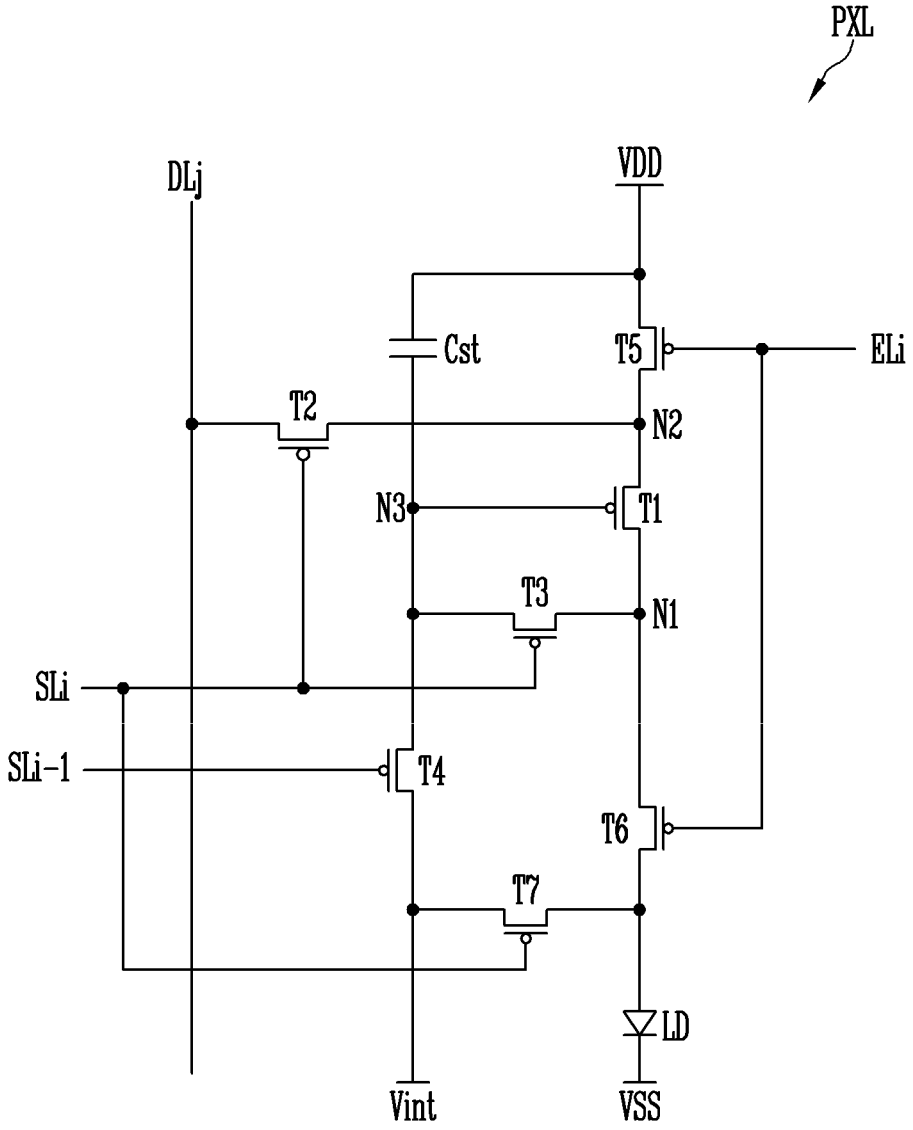
FIG. 2 is a circuit diagram illustrating an example of a pixel included in the display device of FIG. 1.

FIG. 2 is a circuit diagram illustrating an example of the pixel included in the display device of FIG. 1.

Referring to FIG. 2, the pixel PXL may include first to seventh transistors T1 through T7, a storage capacitor Cst, and a light emitting element LD.

Each of the first to seventh transistors T1 to T7 may be implemented as a P-type transistor, but the disclosure is not limited thereto. For example, at least some of the first to seventh transistors T1 to T7 may be implemented as N-type transistors.

A first electrode of the first transistor (e.g., or a driving transistor) T1 may be connected to a second node N2 (e.g., or may be connected to a first power line (e.g., a power line to which the first power voltage VDD is applied) through the fifth transistor T5). A second electrode of the first transistor T1 may be connected to a first node N1 (e.g., or may be connected to an anode of the light emitting element LD through the sixth transistor T6). A gate electrode of the first transistor T1 may be connected to a third node N3. The first transistor T1 may control an amount of a current flowing from the first power line to a second power line (e.g., a power line for transferring the second power voltage VSS) through the light emitting element LD in correspondence with a voltage of the third node N3.

The second transistor (e.g., or a switching transistor) T2 may be connected between the data line DLj and the second node N2. A gate electrode of the second transistor T2 may be connected to the scan line SLi. The second transistor T2 may be turned on when the scan signal is supplied to the scan line SLi, to electrically connect the data line DLj and the first electrode of the first transistor T1 to each other.

The third transistor T3 may be connected between the first node N1 and the third node N3. A gate electrode of the third transistor T3 may be connected to the scan line SLi. The third transistor T3 may be turned on when the scan signal is supplied to the scan line SLi to electrically connect the first node N1 and the third node N3 to each other. Therefore, when the third transistor T3 is turned on, the first transistor T1 may be connected in a diode form. In other words, when the third transistor T3 is turned on, the first transistor T1 may be diode-connected.

The storage capacitor Cst may be connected between the first power line and the third node N3. The storage capacitor Cst may store a voltage corresponding to the data signal and a threshold voltage of the first transistor T1.

The fourth transistor T4 may be connected between the third node N3 and an initialization power line (e.g., a power line for transferring the initialization power voltage Vint). A gate electrode of the fourth transistor T4 may be connected to the previous scan line SLi−1. The fourth transistor T4 may be turned on when the scan signal is supplied to the previous scan line SLi−1, to supply the initialization power voltage Vint to the third node N3. Here, the initialization power voltage Vint may have (e.g., or may be set to have) a voltage level that is lower than that of the data signal.

The fifth transistor T5 may be connected between the first power line and the second node N2. A gate electrode of the fifth transistor T5 may be connected to the light emission control line ELi. The fifth transistor T5 may be turned off when the light emission control signal is supplied to the light emission control line ELi, and may be turned on in other cases (e.g., when the light emission control signal is not supplied to the light emission control line ELi, or when the light emission control signal having a gate-on level is supplied to the light emission control line ELi).

The sixth transistor T6 may be connected between the first node N1 and the light emitting element LD. A gate electrode of the sixth transistor T6 may be connected to the light emission control line ELi. The sixth transistor T6 may be turned off when the light emission control signal is supplied to the light emission control line ELi, and may be turned on in other cases (e.g., when the light emission control signal is not supplied to the light emission control line ELi, or when the light emission control signal having a gate-on level is supplied to the light emission control line ELi).

The seventh transistor T7 may be connected between the initialization power line and the anode of the light emitting element LD. A gate electrode of the seventh transistor T7 may be connected to the scan line SLi. The seventh transistor T7 may be turned on when the scan signal is supplied to the scan line SLi, to provide the initialization power voltage Vint to the anode of the light emitting element LD.

The anode of the light emitting element LD may be connected to the first transistor T1 through the sixth transistor T6, and a cathode of the light emitting element LD may be connected to the second power line. The light emitting element LD may generate light having a desired luminance (e.g., having a predetermined luminance) corresponding to the current supplied from the first transistor T1. The first power voltage VDD may have (e.g., or may be set to have) a voltage level that is greater (e.g., or higher) than that of the second power voltage VSS, so that the current flows to (e.g., or flows through) the light emitting element LD.

Figure 3:
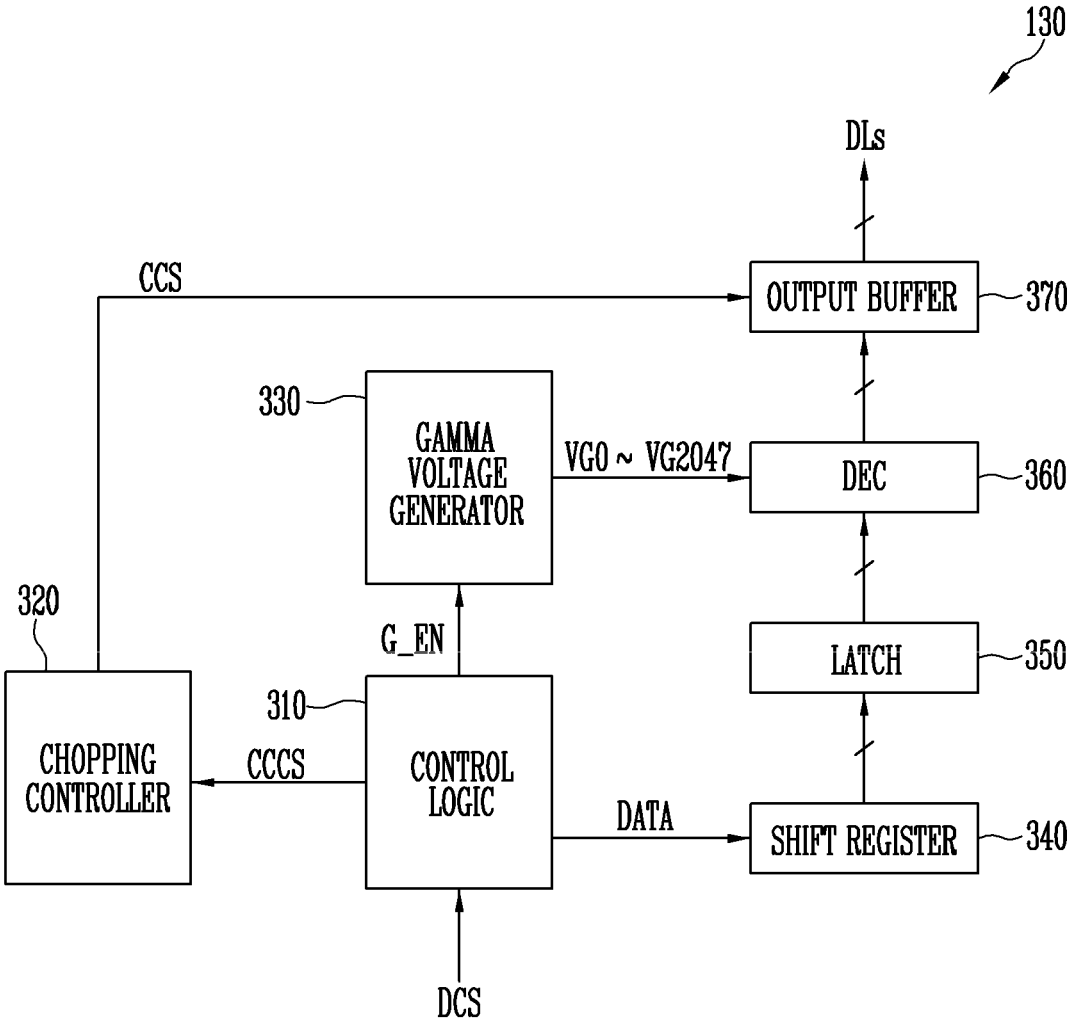
FIG. 3 is a block diagram illustrating an example of a source driver included in the display device of FIG. 1.

FIG. 3 is a block diagram illustrating an example of the source driver included in the display device of FIG. 1.

Referring to FIGS. 1 and 3, the source driver 130 may include a controller (e.g., or a control unit) 310, a chopping controller (e.g., or a chopping control unit) 320, a gamma voltage generator (e.g., or a gamma voltage generation unit) 330, a shift register 340, a latch 350, a decoder (e.g., or a digital-to-analog converter, a digital-to-analog conversion unit, and/or the like) 360, and an output buffer (e.g., or an output buffer unit) 370.

The controller 310 may receive the data control signal DCS from the timing controller 140.

The controller 310 may generate a first control signal CCCS according to (e.g., or based on) the data control signal DCS. The first control signal CCCS may include a pulse, and may be used to change (e.g., to periodically change) the polarity of the offset of the source amplifiers included in (e.g., or configuring) the output buffer 370.

In addition, the controller 310 may generate a bias control signal according to (e.g., or based on) the data control signal DCS. The bias control signal may be used to control a bias voltage Vbias that is applied to the output buffer 370 (or to the source amplifiers).

The controller 310 may generate a gamma enable signal G_EN. The gamma enable signal G_EN may control the gamma voltage generator 330 to generate gamma voltages VG0 to VG2047. The gamma voltages VG0 to VG2047 may be used to convert data DATA (e.g., the image data DATA2 described with reference to FIG. 1) into a data voltage (e.g., a grayscale voltage). For example, in an embodiment, the gamma voltages VG0 to V2047 may include 2048 gamma voltages corresponding to 11 bit data, but this is a non-limiting example, and the gamma voltages VG0 to V2047 are not limited thereto.

The controller 310 may receive serialized data from the timing controller 140, and may change the serialized data into parallelized data DATA. The controller 310 may provide the parallelized data DATA to the shift register 340 (or to the latch 350).

The chopping controller 320 may generate a chopping control signal CCS according to (e.g., or based on) the first control signal CCCS, and may provide the chopping control signal CCS to the output buffer 370.

In addition, the chopping controller 320 may generate bias voltages having various suitable voltage levels in response to the bias control signal. However, the present disclosure is not limited thereto, and in an embodiment, the bias voltages may be generated by a separate bias voltage generator that is independent of (e.g., or separate from) the chopping controller 320.

In various embodiments, the chopping controller 320 may control a slew rate of the chopping control signal CCS, or may control (e.g., may change or vary) a transition speed of the chopping control signal CCS. For example, when the chopping control signal CCS is a square wave or includes a plurality of pulses, the chopping controller 320 may change (e.g., or may vary) a speed at which a voltage level of the chopping control signal CCS changes.

As will be described in more detail below, the components (for example, a touch panel) included in the display device 100 or in a product including the display device 100, and/or a disposition (e.g., or an arrangement) thereof, may be variously modified. Therefore, various components may be affected by the display device 100 (e.g., or the data lines DL1 to DLm (refer to FIG. 1)) depending on a configuration of the display device 100. For example, the slew rate or the transition speed of the chopping control signal CCS may be controlled (e.g., may be set) during a manufacturing process of the display device 100 (or during a manufacturing process of a product including the display device 100) in consideration of a disposition between the components (e.g., an arrangement and/or a distance between the data lines DL1 to DLm and an electrode of the touch panel) and/or the like, or in consideration of a measurement result for an influence that may occur on the components (e.g., for noise generated in the touch panel due to the data lines DL1 to DLm).

The gamma voltage generator 330 may receive the gamma enable signal G_EN to generate the gamma voltages VG0 to VG2047 having various suitable voltage levels.

The shift register 340 may provide the parallelized data DATA to the latch 350. The shift register 340 may generate a latch clock signal, and may provide the latch clock signal to the latch 350. The latch clock signal may be used to control a timing at which the parallelized data DATA is output.

The latch 350 may latch or temporarily store data that is received (e.g., sequentially received) from the shift register 340, and may transfer the data to the decoder 360.

The decoder 360 may convert the received data into a data signal using the gamma voltages VG0 to VG2047. For example, the decoder 360 may receive the data in a first format (e.g., in a digital format, such as a grayscale value or a gray value of the parallelized data DATA) and may convert the received data into a data signal of a second format that is different from the first format (e.g., of an analog format, such as a data voltage) using the gamma voltages VG0 to VG2047.

The output buffer 370 may receive the data signal, and may output the data signal to data lines DLs (e.g., the data lines DL1 to DLm of the display unit 110 described with reference to FIG. 1). The output buffer 370 may include source amplifiers that are connected to the data lines DLs.

While the chopping controller 320 is shown in FIG. 3 as being independent of (e.g., or being separate from) the controller 310 and the output buffer 370, the present disclosure is not limited thereto. For example, in some embodiments, the chopping controller 320 may be included as part of the controller 310, or as part of the output buffer (e.g., or the output buffer unit) 370.

Figure 4:
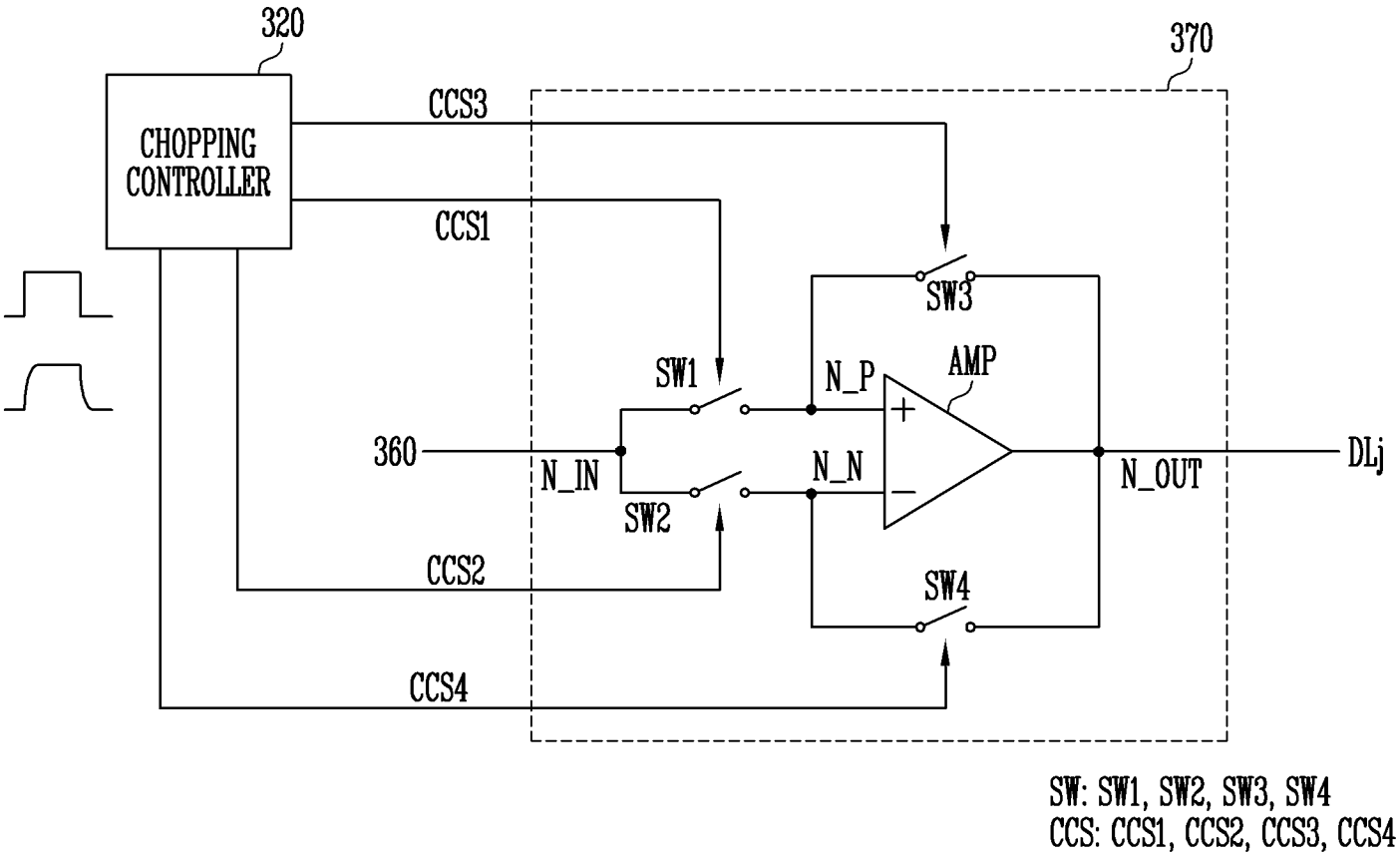
FIG. 4 is a circuit diagram illustrating an example of an output buffer included in the source driver of FIG. 3.

FIG. 4 is a circuit diagram illustrating an example of the output buffer included in the source driver of FIG. 3. In FIG. 4, a portion of the output buffer 370 is shown centering on a circuit (e.g., or the source amplifier) that is connected to the data line DLj shown in FIG. 1.

Referring to FIGS. 3 and 4, the output buffer 370 may include an amplifier (e.g., or a source amplifier) AMP and a chopping circuit SW.

The amplifier AMP may be connected to an output terminal of the decoder 360, or may be connected between the decoder 360 and the data line DLj.

The chopping circuit SW may change (e.g., may periodically change) a polarity of an offset of the amplifier AMP in response to the chopping control signal CCS. The chopping control signal CCS is provided from the chopping controller (e.g., or the chopping control unit) 320, and may include a pulse having a turn-on voltage level.

The chopping circuit SW may include first to fourth switches SW1 to SW4.

The first switch SW1 may be connected between an input node N_IN and a first input terminal of the amplifier AMP (e.g., or a first input node N_P). The second switch SW2 may be connected between the input node N_IN and a second input terminal of the amplifier AMP (e.g., or a second input node N_N). The third switch SW3 may be connected between the first input terminal of the amplifier AMP (or the first input node N_P) and an output terminal of the amplifier AMP (e.g., or an output node N_OUT). The fourth switch SW4 may be connected between the second input terminal of the amplifier AMP (or the second input node N_N) and the output terminal of the amplifier AMP (e.g., or the output node N_OUT).

The first to fourth switches SW1 to SW4 may operate, or may be turned on, in response to the chopping control signal CCS. In this case, the chopping control signal CCS may include a first chopping control signal CCS1, a second chopping control signal CCS2, a third chopping control signal CCS3, and a fourth chopping control signal CCS4. For example, the first switch SW1 may be turned on in response to the first chopping control signal CCS1 having a turn-on voltage level, the second switch SW2 may be turned on in response to the second chopping control signal CCS2 having a turn-on voltage level, the third switch SW3 may be turned on in response to the third chopping control signal CCS3 having a turn-on voltage level, and the fourth switch SW4 may be turned on in response to the fourth chopping control signal CCS4 having a turn-on voltage level.

The first switch SW1 and the fourth switch SW4 may be turned on in response to the first and fourth chopping control signals CCS1 and CCS4 having the turn-on voltage level at (e.g., during) a first time (e.g., or during a first period). The second switch SW2 and the third switch SW3 may be turned on in response to the second and third chopping control signals CCS2 and CCS3 having the turn-on voltage level at (e.g., during) a second time (e.g., or during a second period) that is different from the first time. For example, the first time and the second time may be alternated for every one frame period (e.g., for every one frame period during which the display device 100 (refer to FIG. 1) displays one frame image), but the present disclosure is not limited thereto.

For example, at (or during) the first time, the data signal may be output with an offset having a first polarity through the first input terminal of the amplifier AMP, and at (or during) the second time, the data signal may be output with an offset having a second polarity (e.g., an offset having the same or substantially the same size as that of the offset of the first polarity, and having a polarity different from that of the offset of the first polarity) through the second input terminal of the amplifier AMP.

Figure 5:
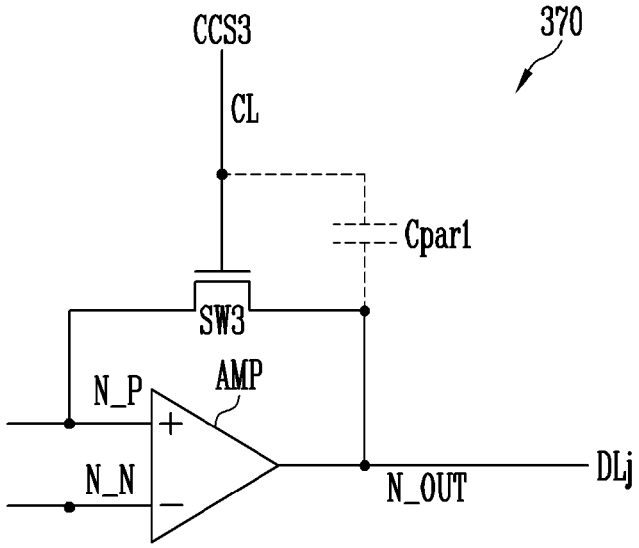
FIG. 5 is a circuit diagram illustrating an example of the output buffer of FIG. 4.

FIG. 5 is a circuit diagram illustrating an example of the output buffer of FIG. 4. In FIG. 5, a portion of the output buffer 370 is shown centering on the third switch SW3 shown in FIG. 4.

Referring to FIGS. 4 and 5, the third switch SW3 may include (or may be) an N-type transistor (e.g., an N-channel metal oxide semiconductor (NMOS) transistor, or an oxide semiconductor transistor) as a non-limiting example, but the present disclosure is not limited thereto. For example, in another embodiment, the third switch SW3 may include (or may be) a P-type transistor.

A first parasitic capacitor Cpar1 may be formed between the output node N_OUT to which the output terminal of the amplifier AMP is connected, and a control line CL for transmitting the third chopping control signal CCS3 to the third switch SW3. For example, a wire connected to the output node N_OUT may overlap with or be adjacent to the control line CL, and thus, the first parasitic capacitor Cpar1 may be formed between the wire connected to the output node N_OUT and the control line CL.

A high frequency component of the third chopping control signal CCS3 may be transferred to the output node N_OUT through the first parasitic capacitor Cpar1, and may appear as noise for the data signal transmitted through the data line DLj.

While FIG. 5 shows that the first parasitic capacitor Cpar1 is formed corresponding to (e.g., at or in) the third switch SW3, the present disclosure is not limited thereto. For example, a parasitic capacitor may be formed corresponding to (e.g., at or in) the fourth switch SW4, and/or parasitic capacitors may be formed corresponding to (e.g., at or in) the first switch SW1 and the second switch SW2, respectively (e.g., see FIG. 4). Therefore, high frequency components of one or more of (e.g., each of) the first, second, third, and fourth chopping control signals CCS1, CCS2, CCS3, and CCS4 (e.g., refer to FIG. 4) may appear as noise for the data signal.

Figure 6:
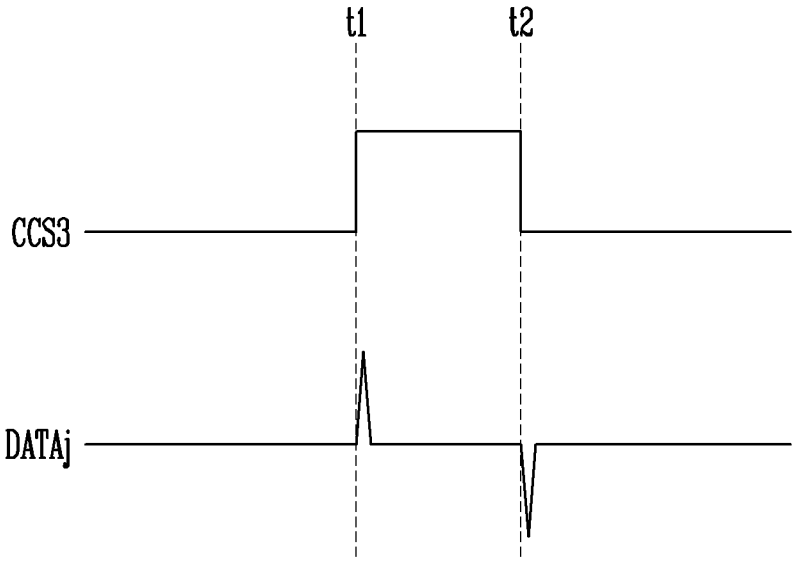
FIG. 6 is a waveform diagram illustrating an example of signals that are measured in the output buffer of FIG. 5.

FIG. 6 is a waveform diagram illustrating an example of signals that are measured in the output buffer of FIG. 5.

Referring to FIGS. 5 and 6, the third chopping control signal CCS3 may transition from a turn-off voltage level (e.g., a logic low level, or a gate off voltage level) to a turn-on voltage level (e.g., a logic high level, or a gate on voltage level) at a first time point t1, and may transition to the turn-off voltage level at a second time point t2. Here, the turn-off voltage level may be a suitable voltage level for turning off the transistor (e.g., the third switch SW3) shown in FIG. 5, and the turn-on voltage level may be a suitable voltage level for turning on the transistor (e.g., the third switch SW3).

At (or during) the first time point t1, noise (e.g., of or having an impulse form) corresponding to the change of the third chopping control signal CCS3 (e.g., the transition from the turn-off voltage level to the turn-on voltage level) may occur in the data signal DATAj transmitted through the data line DLj.

Similarly, at (or during) the second time point t2, noise (e.g., of or having an impulse form) corresponding to the change of the third chopping control signal CCS3 (e.g., the transition from the turn-on voltage level to the turn-off voltage level) may occur in the data signal DATAj transmitted through the data line DLj.

The influence of such noise on the data signal that is stored in the pixel may be minimal. As described with reference to FIG. 2, because the data signal DATAj is stored in the storage capacitor Cst of the pixel PXL, and/or because the storage capacitor Cst is charged during a particular time in response to the scan signal transferred through the scan line SLi, the influence of the noise for the pixel PXL may be excluded (or ignored). For example, the noise of the pixel PXL may be excluded by causing the transition time points (e.g., the first time point t1 and the second time point t2) of the data signal DATAj to not be overlapped with the scan signal of the turn-on voltage level (e.g., when the scan signal has the turn-on voltage level).

However, as will be described in more detail below with reference to FIGS. 12 to 15, one or more other components (for example, a touch panel that is not synchronized with the source driver 130), which may be included in the display device 100 or which may be included in a product including the display device 100, may be affected by the noise generated in the data line DLj, and thus, may not operate (or may not function) correctly.

Therefore, the chopping controller 320 (e.g., refer to FIG. 4), according to various embodiments of the present disclosure, may vary (e.g., may change) the slew rate or the transition speed of the chopping control signal CCS (e.g., the third chopping control signal CCS3). For example, when the slew rate or the transition speed of the chopping control signal CCS is reduced, the high frequency component of the chopping control signal CCS may be reduced, and thus, the noise of the data signal DATAj may be reduced. However, as the slew rate or the transition speed of the chopping control signal CCS is reduced, a time for stabilizing or substantially stabilizing the output buffer 370 may be increased (e.g., additional time for stabilizing or substantially stabilizing the output buffer 370 may be needed or desired). Therefore, the slew rate or the transition speed of the chopping control signal CCS may be varied (e.g., may be changed) to a suitable slew rate or transition speed at which the noise does not occur in the other components (e.g., a touch panel). For example, the slew rate or the transition speed of the chopping control signal CCS may be set to have the highest slew rate or the fastest transition speed within a suitable range in which the noise does not occur in the other components (e.g., a touch panel).

Figure 7:
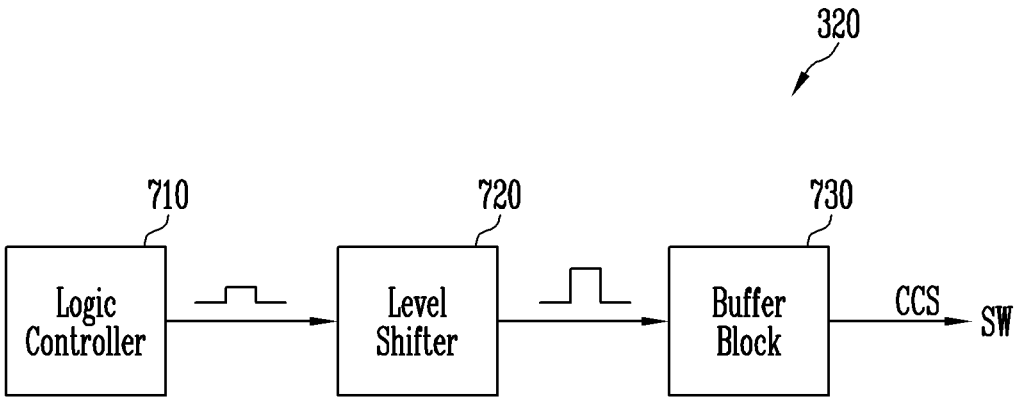
FIG. 7 is a block diagram illustrating an example of a chopping controller included in the source driver of FIG. 3.

FIG. 7 is a block diagram illustrating an example of the chopping controller included in the source driver of FIG. 3.

Referring to FIGS. 3, 4, and 7, the chopping controller 320 may include a logic control circuit (e.g., a logic controller or a logic control block) 710, a level shifter 720, and a buffer circuit (e.g., a buffer or a buffer block) 730.

The logic control circuit 710 may generate a first control signal including a pulse. For example, the first control signal may be the same or substantially the same as the first control signal CCCS described with reference to FIG. 3, and in this case, the logic control circuit 710 may be included in (e.g., as part of) the controller 310.

The level shifter 720 may shift a level of the first control signal to generate a second control signal. For example, the level shifter 720 may shift the level of the first control signal up to generate the second control signal.

The buffer circuit 730 may output the second control signal as the chopping control signal CCS, and may vary the slew rate of the chopping control signal CCS. For example, the slew rate may indicate a rate at which the chopping control signal CCS follows the second control signal, or a change rate of the chopping control signal CCS according to time. The chopping control signal CCS output from the buffer circuit 730 may be provided to the chopping circuit SW.

In some embodiments, the buffer circuit 730 may include sub buffers connected in parallel to the chopping circuit SW, and sub switches respectively connecting the sub buffers to the level shifter 720 in series.

Figure 8:
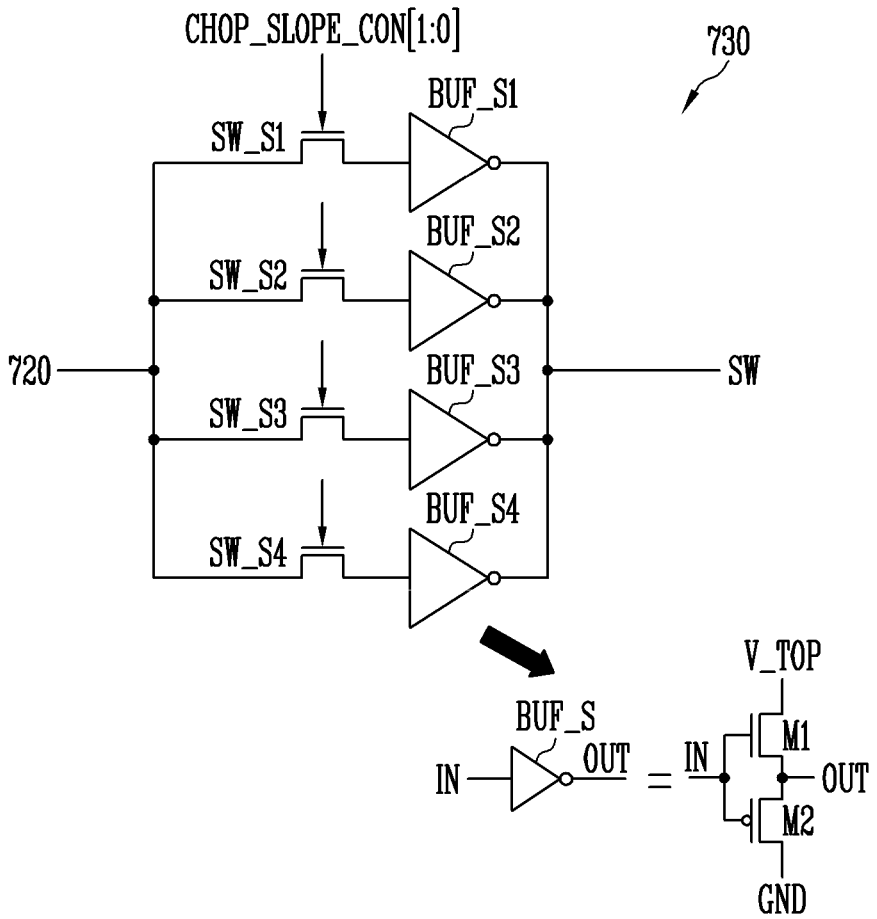
FIG. 8 is a circuit diagram illustrating an example of a buffer circuit included in the chopping controller of FIG. 7.

FIG. 8 is a circuit diagram illustrating an example of the buffer circuit included in the chopping controller of FIG. 7.

Referring to FIG. 8, the buffer circuit 730 may include first to fourth sub buffers BUF_S1 to BUF_S4, and first to fourth sub switches SW_S1 to SW_S4.

The first sub buffer BUF_S1 and the first sub switch SW_S1 may be connected in series between the level shifter 720 and the chopping circuit SW. Similarly, the second sub buffer BUF_S2 and the second sub switch SW_S2 may be connected in series between the level shifter 720 and the chopping circuit SW, the third sub buffer BUF_S3 and the third sub switch SW_S3 may be connected in series between the level shifter 720 and the chopping circuit SW, and the fourth sub buffer BUF_S4 and the fourth sub switch SW_S4 may be connected in series between the level shifter 720 and the chopping circuit SW.

Each of the first to fourth sub buffers BUF_S1 to BUF_S4 may be connected in series between a first driving voltage V_TOP and a second driving voltage GND, and may include (e.g., may be configured of) an N-type transistor M1 and a P-type transistor M2. For example, as shown in FIG. 8, each of the first to fourth sub buffers BUF_S1 to BUF_S4 may include the transistors M1 and M2 connected in series between the first driving voltage V_TOP and the second driving voltage GND. A gate electrode of each of the transistors M1 and M2 may be connected to an input terminal IN of the respective sub buffer. The input terminal IN of the respective sub buffer may be connected to a corresponding sub switch, and an output terminal OUT of the respective sub buffer may be connected to the chopping circuit SW. The first to fourth sub buffers BUF_S1 to BUF_S4 may have the same or substantially the same buffer size as each other, but the present disclosure is not limited thereto. For example, at least one of the first to fourth sub buffers BUF_S1 to BUF_S4 may have a different buffer size (e.g., a mutually different buffer size) from that of at least one of the others.

Each of the first to fourth sub switches SW_S1 to SW_S4 may include (e.g., may be implemented as) an N-type transistor, but the present disclosure is not limited thereto. At least one of the first to fourth sub switches SW_S1 to SW_S4 may be controlled (e.g., may be turned on) according to (e.g., based on) a selection signal CHOP_SLOPE_CON[1:0]. The selection signal CHOP_SLOPE_CON [1:0] may be a suitable signal (e.g., a preset signal or a predetermined signal) that is provided from the controller 310 (e.g., see FIG. 3) or the like.

While FIG. 8 shows that the buffer circuit 730 includes four pairs of sub buffers and sub switches as a non-limiting example, the present disclosure is not limited thereto, and the buffer circuit 730 may include any suitable number of pairs of sub buffers and sub switches. For example, the buffer circuit 730 may include two pairs of sub buffers and sub switches, three pairs of sub buffers and sub switches, five or more pairs of sub buffers and sub switches, and/or the like.

Figure 9:
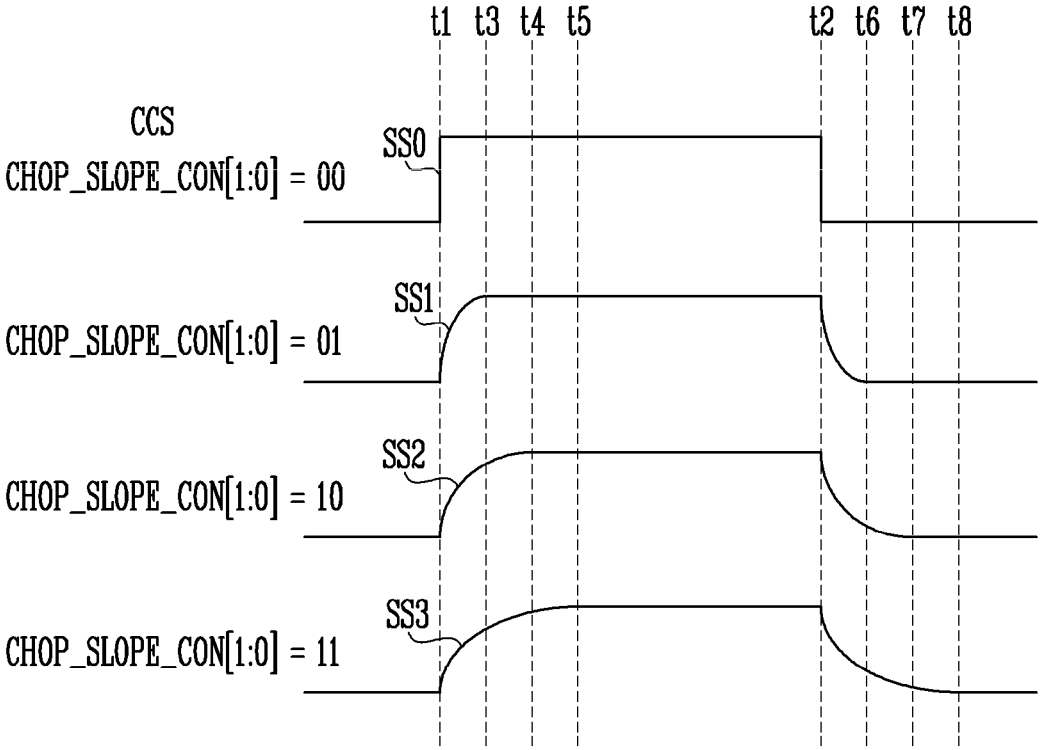
FIG. 9 is a waveform diagram illustrating an example of a chopping control signal output from a buffer of FIG. 8.

FIG. 9 is a waveform diagram illustrating an example of the chopping control signal output from the buffer of FIG. 8.

Referring to FIGS. 8 and 9, when the selection signal CHOP_SLOPE_CON[1:0] has a first value (for example, 00), each of (e.g., all of) the first to fourth sub switches SW_S1 to SW_S4 may be turned on.

In this case, as described with reference to FIG. 6, the chopping control signal CCS may transition (e.g., may be quickly transitioned) from the turn-off voltage level to the turn-on voltage level at the first time point t1, and may transition (e.g., may be quickly transitioned) from the turn-on voltage level to the turn-off voltage level at the second time point t2.

When the selection signal CHOP_SLOPE_CON[1:0] has a second value (for example, 01), three of the first to fourth sub switches SW_S1 to SW_S4 (for example, the first to third sub switches SW_S1 to SW_S3) may be turned on.

In this case, the chopping control signal CCS may transition from the turn-off voltage level to the turn-on voltage level during (e.g., in) a period between the first time point t1 and a third time point t3, and may transition from the turn-on voltage level to the turn-off voltage level during (e.g., in) a period between the second time point t2 and a sixth time point t6.

A slope (or a slope of a rising edge and/or a falling edge of a pulse) of the chopping control signal CCS in the case where the selection signal CHOP_SLOPE_CON[1:0] has the second value may be less than (e.g., gentler than) the slope of the chopping control signal CCS in the case where the selection signal CHOP_SLOPE_CON[1:0] has the first value.

When the selection signal CHOP_SLOPE_CON[1:0] has a third value (for example, 10), two of the first to fourth sub switches SW_S1 to SW_S4 (for example, the first and second sub switches SW_S1 and SW_S2) may be turned on. In this case, the chopping control signal CCS may transition from the turn-off voltage level to the turn-on voltage level during (e.g., in) a period between the first time point t1 and a fourth time point t4, and may transition from the turn-on voltage level to the turn-off voltage level during (e.g., in) a period between the second time point t2 and a seventh time point t7. The slope of the chopping control signal CCS in the case where the selection signal CHOP_SLOPE_CON[1:0] has the third value may be less than (e.g., gentler than) the slope of the chopping control signal CCS in the case where the selection signal CHOP_SLOPE_CON[1:0] has the second value.

When the selection signal CHOP_SLOPE_CON[1:0] has a fourth value (for example, 11), one of the first to fourth sub switches SW_S1 to SW_S4 (for example, the first sub switch SW_S1) may be turned on. In this case, the chopping control signal CCS may transition from the turn-off voltage level to the turn-on voltage level during (e.g., in) a period between the first time point t1 and a fifth time point t5, and may transition from the turn-on voltage level to the turn-off voltage level during (e.g., in) a period between the second time point t2 and an eighth time point t8. The slope of the chopping control signal CCS in the case where the selection signal CHOP_SLOPE_CON[1:0] has the fourth value may be less than (e.g., gentler than) the slope of the chopping control signal CCS in the case where the selection signal CHOP_SLOPE_CON[1:0] has the third value.

Accordingly, the buffer size of the buffer circuit 730 may vary (e.g., may be changed) according to the selection signal CHOP_SLOPE_CON[1:0] (e.g., by controlling the sub switches SW_S1 to SW_S4), and the slew rate (e.g., the transition speed, or the slope) of the chopping control signal CCS that is output through the buffer circuit 730 may be controlled. For example, as the buffer size of the buffer circuit 730 is reduced, the slew rate of the chopping control signal CSS may be reduced.

According to one or more embodiments of the present disclosure, during (e.g., in) the manufacturing process of the display device 100 of FIG. 1, noise generated in other components (e.g., a touch panel) may be measured while changing a value of the selection signal CHOP_SLOPE_CON[1:0]. According to a measurement result of the noise, a suitable or optimum value of the selection signal CHOP_SLOPE_CON[1:0] (for example, a value that causes the slope of the chopping control signal CCS to be the largest without generating noise) may be selected or set. In other words, the buffer size of the buffer circuit 730 may be changed (e.g., may be set) to have the largest size within the range at (e.g., in) which the noise does not occur.

While FIG. 9 shows that the first to fourth sub buffers BUF_S1 to BUF_S4 have the same or substantially the same size (or buffer size) as each other, the present disclosure is not limited thereto. For example, the second sub buffer BUF_S2 may have a size that is twice the size of the first sub buffer BUF_S1, and the third sub buffer BUF_S3 may have a size that is twice the size of the second sub buffer BUF_S2. In this case, only the first sub switch SW_S1 corresponding to the first sub buffer BUF_S1 may be turned on in correspondence with the fourth value of the selection signal CHOP_SLOPE_CON[1:0] (for example, 11), only the second sub switch SW_S2 corresponding to the second sub buffer BUF_S2 may be turned on in correspondence with the third value of the selection signal CHOP_SLOPE_CON[1:0] (for example, 10), only the first and second sub buffers BUF_S1 and BUF_S2 may be turned on in correspondence with the second value of the selection signal CHOP_SLOPE_CON[1:0] (for example, 01), and only the third sub buffer BUF_S3 may be turned on in correspondence with the first value of the selection signal CHOP_SLOPE_CON[1:0] (for example, 00).

Figure 10:
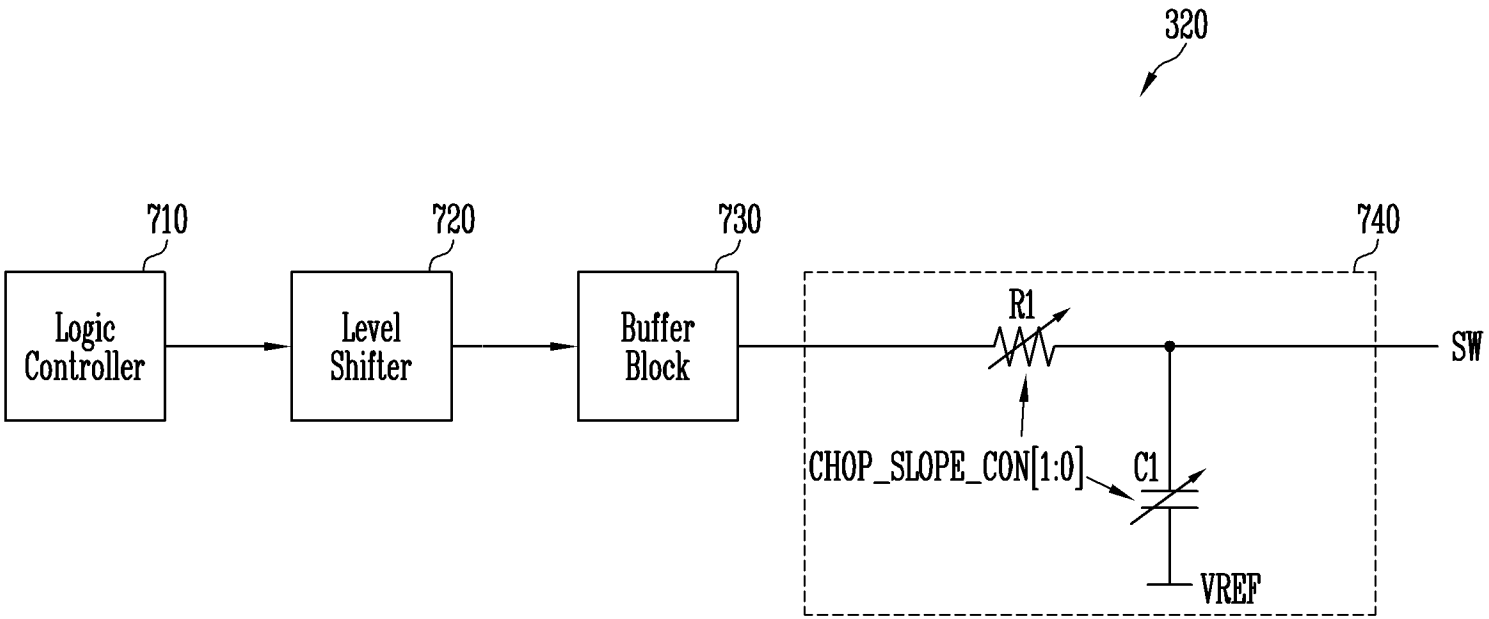
FIG. 10 is a block diagram illustrating another example of the chopping controller included in the source driver of FIG. 3.

FIG. 10 is a block diagram illustrating another example of the chopping controller included in the source driver of FIG. 3.

Referring to FIGS. 7 and 10, the chopping controller 320 of FIG. 10 is different from the chopping controller 320 of FIG. 7 in that the chopping controller 320 of FIG. 10 further includes an analog filter (or a low pass filter) 740. The other elements and components of the chopping controller 320 of FIG. 10 may be the same or substantially the same as those of FIG. 7, and thus, redundant description thereof may be simplified or may not be repeated.

The buffer circuit 730 may output the second control signal provided from the level shifter 720 as the chopping control signal CCS. Unlike the buffer circuit 730 described with reference to FIG. 7, the buffer circuit 730 shown in FIG. 10 may not change the slew rate of the chopping control signal CCS, but the present disclosure is not limited thereto.

The analog filter 740 may be connected between the output terminal of the buffer circuit 730 and the chopping circuit SW, and may filter (e.g., may variably filter) the high frequency component of the chopping control signal CCS. In other words, the analog filter 740 may control a cut-off frequency, and thus, the slope of the chopping control signal CCS may vary (e.g., may be changed).

The analog filter 740 may include a variable resistor R1 and a variable capacitor C1. The variable resistor R1 may be connected between the buffer circuit 730 and the chopping circuit SW, and the variable capacitor C1 may be connected between the chopping circuit SW and a reference voltage line VREF (for example, ground). The variable resistor R1 may include (e.g., may be implemented with) a plurality of resistors and switching elements. The variable capacitor C1 may include (e.g., may be implemented with) a plurality of capacitors and switching elements.

At least one of a resistance of the variable resistor R1 and a capacitance of the variable capacitor C1 may be changed (e.g., may be varied) according to (e.g., based on) the selection signal CHOP_SLOPE_CON[1:0]. Referring to FIG. 9, for example, when the selection signal CHOP_SLOPE_CON[1:0] has the first value (for example, 00), each of the resistance of the variable resistor R1 and the capacitance of the variable capacitor C1 may be the smallest. As another example, when the selection signal CHOP_SLOPE_CON [1:0] has the fourth value (for example, 11), each of the resistance of the variable resistor R1 and the capacitance of the variable capacitor C1 may be the largest.

Figure 11:
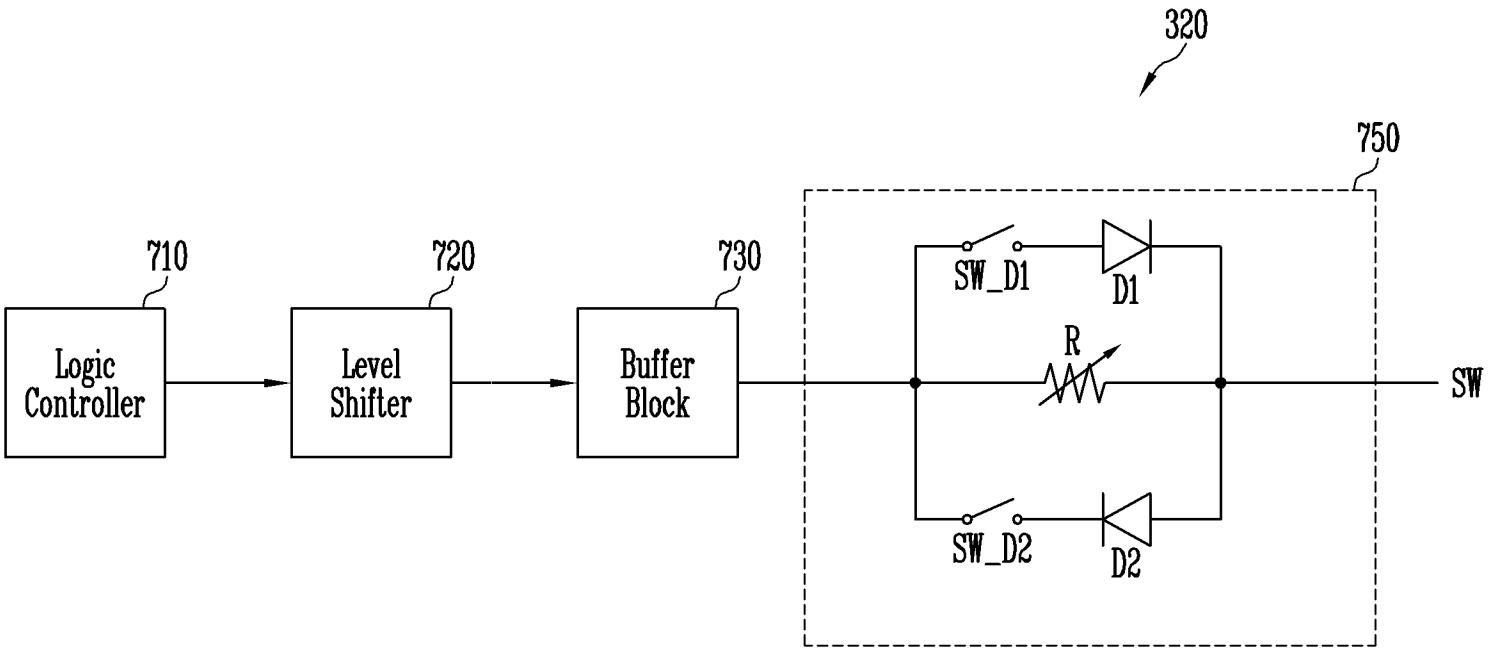
FIG. 11 is a block diagram illustrating another example of the chopping controller included in the source driver of FIG. 3.

FIG. 11 is a block diagram illustrating another example of the chopping controller included in the source driver of FIG. 3.

Referring to FIGS. 7, 10, and 11, the chopping controller 320 of FIG. 11 is different from the chopping controllers 320 of FIGS. 7 and 10 in that the chopping controller 320 of FIG. 11 further includes a delay element 750 (e.g., instead of the analog filter 740). The other elements and components of the chopping controller 320 of FIG. 11 may be the same or substantially the same as those of FIGS. 7 and 10, and thus, redundant description thereof may be simplified or may not be repeated.

The delay element 750 may be connected between the buffer circuit 730 and the chopping circuit SW.

The delay element 750 may include a resistor R, first and second diodes D1 and D2, and first and second delay switching elements SW_D1 and SW_D2. The resistor R may be connected between the buffer circuit 730 and the chopping circuit SW. The first diode D1 and the first delay switching element SW_D1 may be connected in series with each other, and may be connected to the resistor R in parallel. The second diode D2 and the second delay switching device SW_D2 may be connected in series with each other, and may be connected to the resistor R in parallel. The first and second delay switching elements SW_D1 and SW_D2 may be controlled (e.g., may be turned on or turned off) in response to a selection signal (e.g., a preset or a predetermined selection signal).

The resistor R may include (e.g., may be configured of) a variable resistor. The resistor R may delay and transmit the chopping control signal CCS (e.g., the rising edge and/or the falling edge of the chopping control signal CCS) provided from the buffer circuit 730. However, the present disclosure is not limited thereto, for example, instead of the resistor R, the analog filter 740 described with reference to FIG. 10 may be applied.

The first diode D1 and the second diode D2 may be connected in different directions (or different polarities) from each other. The first diode D1 may transmit the chopping control signal CCS provided from the buffer circuit 730 without delay of the rising edge of the chopping control signal CCS, and the second diode D2 may transmit the chopping control signal CCS without delay of the falling edge of the chopping control signal CCS.

In other words, the delay element 750 may delay the chopping control signal CCS or may control the slew rate of the chopping control signal CCS using the resistor R, and may control the slew rate for at least one of the rising edge and the falling edge of the chopping control signal CCS using the first diode D1 and the second diode D2.

Figure 12:
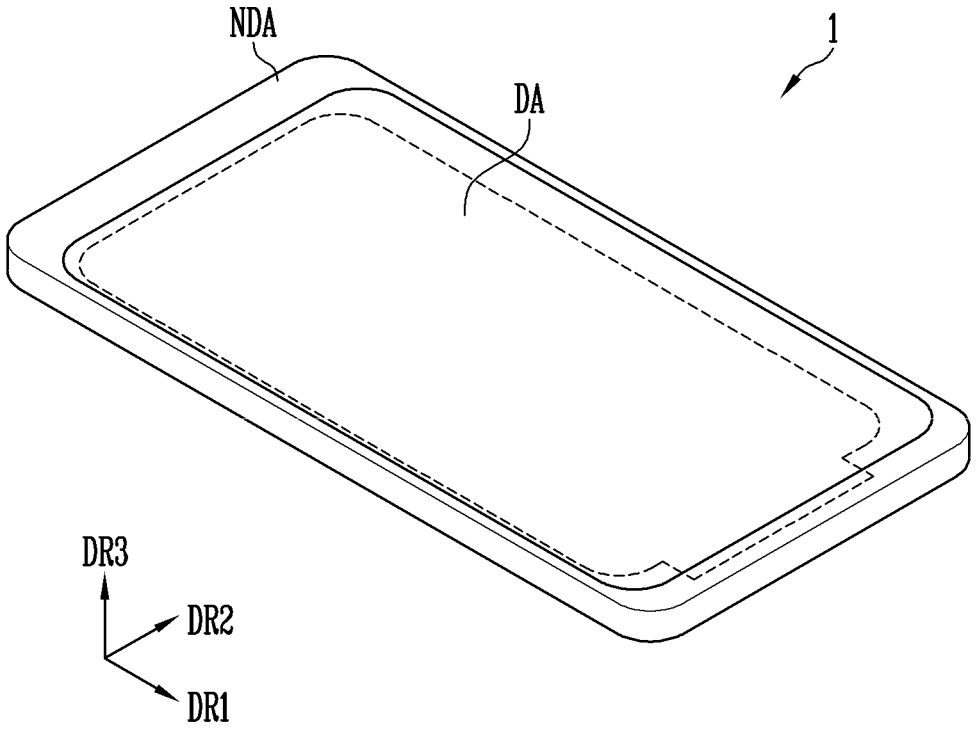
FIG. 12 is a diagram illustrating a display device according to another embodiment of the disclosure.
Figure 13:
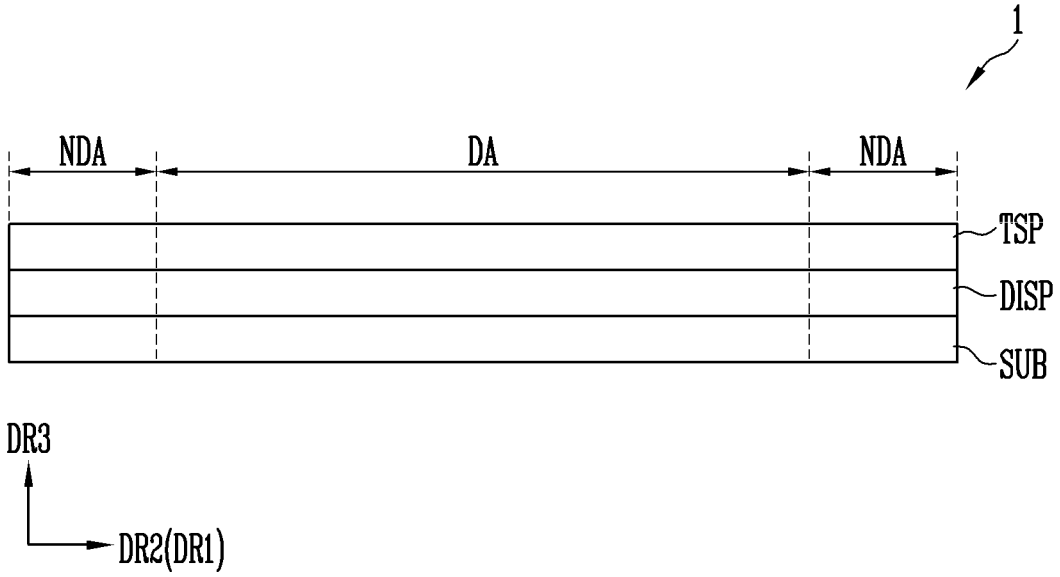
FIG. 13 is a cross-sectional view illustrating an example of the display device of FIG. 12.

FIG. 12 is a diagram illustrating the display device according to another embodiment of the disclosure. FIG. 13 is a cross-sectional view illustrating an example of the display device of FIG. 12.

Referring to FIGS. 12 and 13, the display device 1 may display an image. The display device 1 may be included in (e.g., may be a part of) a portable terminal (e.g., a portable electronic device), for example, such as a tablet PC, a smartphone, a personal digital assistant (PDA), a portable multimedia player (PMP), a wristwatch type electronic device (e.g., a smartwatch, a fitness watch, a health watch, and/or the like), a game machine, and/or the like. However, the display device 1 is not limited thereto. For example, the display device 1 may be included in (e.g., may be a part of) a large electronic device, for example, such as a television, an external billboard, and/or the like, or may be included in (e.g., may be a part of) a small to medium electronic device, for example, such as a personal computer, a notebook computer, a car navigation device, a camera, and/or the like.

The display device 1 may include a display area DA and a non-display area NDA. The display area DA may be defined as a portion of the display device 1 that displays an image, and the non-display area NDA may be defined as a portion of the display device 1 that does not display an image.

The display area DA may be located (e.g., may be positioned) at a center portion (or a central area) of the display device 1, and may have a larger area (e.g., a relatively larger area) than that of the non-display area NDA. The display area DA may include (e.g., may be provided with) the display unit 110 described with reference to FIG. 1, or the display area DA may correspond to the display unit 110.

The non-display area NDA may be located (e.g., may be positioned) at (e.g., in or on) at least one side of the display area DA, or at (e.g., in or on) a vicinity of the display area DA. The non-display area NDA may correspond to (e.g., may be) an area (e.g., a bezel area) extending from an outer boundary (e.g., from a periphery) of the display area DA to an edge (e.g., to a periphery or to a bezel) of the display device 1. For example, in some embodiments, the non-display area DA may surround (e.g., around the periphery of) the display area DA. The scan driver 120, the source driver 130, the timing controller 140, and/or the light emission driver 150 described with reference to FIG. 1 may be provided at (e.g., in or on) the non-display area NDA.

The display device 1 may include a base layer (e.g., a substrate) SUB, a display layer (e.g., a display panel) DISP, and a touch sensing layer (e.g., a touch panel) TSP.

The base layer SUB may include (e.g., may be formed of) an insulating material, for example, such as glass, resin, and/or the like. The base layer SUB may include (e.g., may be formed of) a material having flexibility so as to be bendable or foldable, and may have a single layer structure or a multi-layered structure.

The display layer DISP may be formed on the base layer SUB (e.g., in a third direction DR3, or in a thickness direction DR3 of the base layer SUB). The display layer DISP may be the same or substantially the same as the display device 100 described above with reference to FIG. 1, and thus, redundant description thereof may not be repeated.

The touch sensing layer TSP may be disposed on the display layer DISP. The touch sensing layer TSP may be provided at (e.g., in or on) the non-display area NDA (or a non-sensing area) and the display area DA (or a sensing area). The touch sensing layer TSP may include a touch electrode, and a sensing wire connected to the touch electrode.

The touch sensing layer TSP may be formed integrally with or directly with the display layer DISP. However, the present disclosure is not limited thereto. For example, the touch sensing layer TSP may be manufactured as a separate touch panel that is independent from (e.g., different from) the display layer DISP (or the display panel), and may be coupled to the display layer DISP through an adhesive layer (for example, an optically clear resin (OCR), an optically clear adhesive (OCA), and/or the like).

Figure 14:
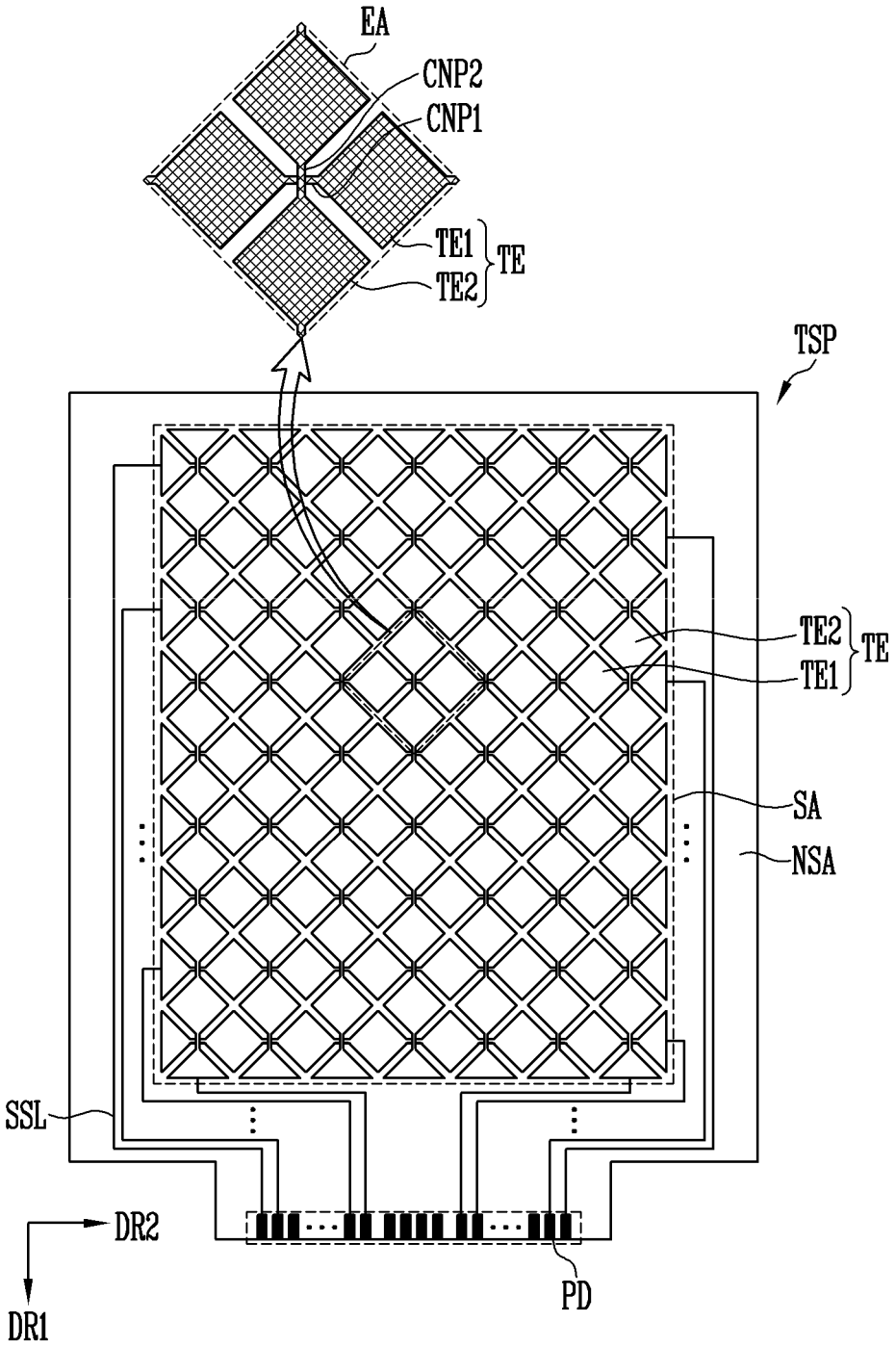
FIG. 14 is a plan view illustrating an example of a touch sensing layer included in the display device of FIG. 13.

FIG. 14 is a plan view illustrating an example of the touch sensing layer included in the display device of FIG. 13.

Referring to FIGS. 13 and 14, the touch sensing layer TSP may include a sensing area SA and a non-sensing area NSA. The sensing area SA may correspond to the display area DA of the display device 1, and the non-sensing area NSA may correspond to the non-display area NDA of the display device 1.

A touch electrode TE may be provided at (e.g., in or on) the sensing area SA. A sensing line SSL and a pad portion PD may be provided at (e.g., in or on) the non-sensing area NSA.

The touch electrode TE may include a first touch electrode TE1 and a second touch electrode TE2. The first touch electrode TE1 and the second touch electrode TE2 may be alternately disposed, and may be connected along different directions (e.g., along mutually different directions).

The first touch electrodes TE1 may be arranged in a matrix form, and may be electrically connected to each other along a second direction (e.g., a second progression direction) DR2 to form a plurality of parallel touch electrode rows. The first touch electrode TE1 of one touch electrode row may be electrically connected to an adjacent first touch electrode TE1 of the one touch electrode row through a first connection pattern (or a first bridge pattern) CNP1.

The second touch electrodes TE2 may be arranged in a matrix form, and may be electrically connected to each other along a first direction DR1 that crosses the second direction DR2 to form a plurality of parallel touch electrode columns. The second touch electrode TE2 of one touch electrode column may be electrically connected to an adjacent second touch electrode TE2 of the one touch electrode column through a second connection pattern (or a second bridge pattern) CNP2.

Each of the first touch electrodes TE1 (or the touch electrode rows) and the second touch electrodes TE2 (or the touch electrode columns) may be electrically connected to a corresponding sensing pad included at (e.g., in or on) the pad portion PD through a corresponding sensing line SSL.

In an embodiment, each of the touch electrodes TE and the connection patterns CNP1 and CNP2 may include a plurality of conductive lines (e.g., a plurality of conductive thin lines). For example, as shown in the enlarged view of the touch area EA in FIG. 14, each of the touch electrodes TE and the connection patterns CNP1 and CNP2 may include a plurality of first conductive thin lines that extend in one direction and are parallel to or substantially parallel to each other, and a plurality of second conductive thin lines that extend in another direction crossing the first conductive thin lines and are parallel to or substantially parallel to each other. In other words, each of the touch electrodes TE and the connection patterns CNP1 and CNP2 may have a mesh structure.

However, the touch electrode TE and the connection patterns CNP1 and CNP2 are not limited thereto. For example, the touch electrode TE and the connection patterns CNP1 and CNP2 may include a transparent conductive material, for example, such as ITO and/or IZO.

The sensing line SSL may electrically connect the touch electrode TE and a driving circuit to each other. The sensing line SSL may transfer a sensing input signal from the driving circuit to the touch electrode TE, or may transfer a sensing output signal from the touch electrode TE to the driving circuit.

Figure 15:
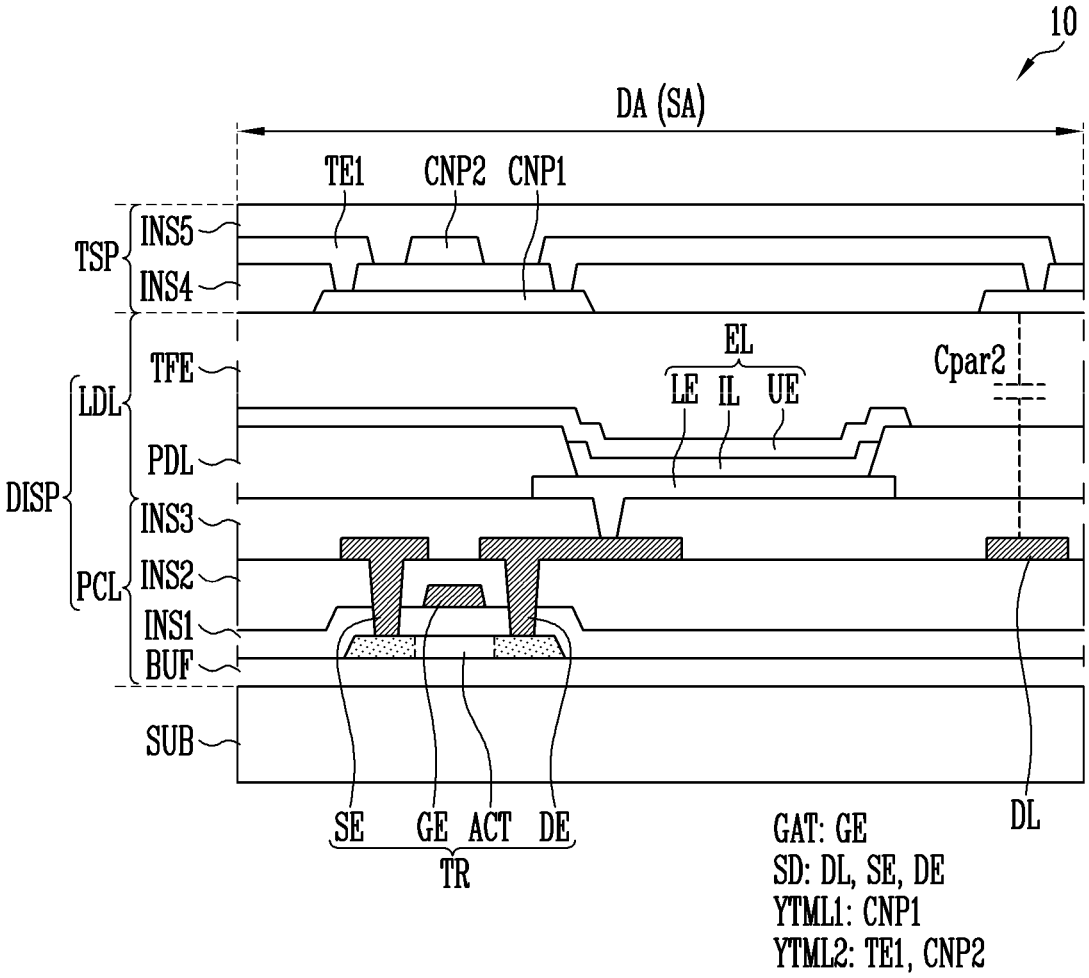
FIG. 15 is a cross-sectional view illustrating an example of the display device of FIG. 13.

FIG. 15 is a cross-sectional view illustrating an example of the display device of FIG. 13. FIG. 15 shows an enlarged portion (e.g., the pixel) of the display area DA of the display device 1.

Referring to FIGS. 13 to 15, the display layer DISP may be disposed on the base layer SUB. The display layer DISP may include a pixel circuit layer PCL and a light emitting element layer (or a display element layer) LDL.

The pixel circuit layer PCL may be disposed on the base layer SUB. The pixel circuit layer PCL may include at least one transistor TR, and one or more lines (for example, the data line DL corresponding to one of the data lines DL1 to DLm described with reference to FIG. 1) that are provided at (e.g., in or on) the display area DA of the base layer SUB.

The pixel circuit layer PCL may include a buffer layer BUF, a semiconductor layer, a first insulating layer INS1, a first conductive layer GAT, a second insulating layer INS2, a second conductive layer SD, and a third insulating layer INS3.

The buffer layer BUF may be disposed on a surface (e.g., on an entire surface) of the base layer SUB. The buffer layer BUF may perform a surface planarization function, prevent or substantially prevent diffusion of an impurity ion, and/or prevent or substantially prevent penetration of moisture or external air. The buffer layer BUF may include, for example, silicon nitride, silicon oxide, silicon oxynitride, and/or the like. However, the present disclosure is not limited thereto, and the buffer layer BUF may be omitted as desired or necessary, for example, according to a type of the base layer SUB, a process condition, and/or the like.

The semiconductor layer may be disposed on the buffer layer BUF (or on the base layer SUB). The semiconductor layer may include (e.g., may be) an active layer forming a channel of the transistor TR. The semiconductor layer may include a source region and a drain region, which are in contact with a source electrode SE and a drain electrode DE, respectively, which will be described in more detail below. A region between the source region and the drain region may be a channel region ACT.

The semiconductor layer may include polysilicon, amorphous silicon, oxide semiconductor, or the like. The channel region ACT of the semiconductor pattern may include (e.g., may be) a semiconductor pattern that is not doped with an impurity, and may be, for example, an intrinsic semiconductor. The source region and the drain region may include (e.g., may be) semiconductor patterns that are doped with an impurity. For example, an impurity such as an n-type impurity, a p-type impurity, other metals, and/or the like may be used to dope the semiconductor patterns of the source region and the drain region.

The first insulating layer (or a gate insulating layer) INS1 may be disposed on the semiconductor layer and the buffer layer BUF (or on the base layer SUB). The first insulating layer INS1 may be disposed over a surface (e.g., may be generally disposed over an entire surface) of the base layer SUB. The first insulating layer INS1 may include (e.g., may be) a gate insulating film having a gate insulating function.

The first insulating layer INS1 may include an inorganic insulating material, for example, such as a silicon compound, a metal oxide, and/or the like. For example, the first insulating layer INS1 may include silicon oxide, silicon nitride, silicon oxynitride, aluminum oxide, tantalum oxide, hafnium oxide, zirconium oxide, titanium oxide, and/or the like, or a combination thereof. The first insulating layer INS1 may include (e.g., may be) a single film, or a multi-layered film including (e.g., formed of) a plurality of stacked films of different materials.

The first conductive layer GAT may be disposed on the first insulating layer INS1. The first conductive layer GAT may include a gate electrode GE. The gate electrode GE may be disposed to overlap with the semiconductor layer (or to overlap with the channel region ACT of the semiconductor layer).

The first conductive layer GAT may include one or more metals selected from, for example, molybdenum (Mo), aluminum (Al), platinum (Pt), palladium (Pd), silver (Ag), magnesium (Mg), gold (Au), nickel (Ni), neodymium (Nd), iridium (Ir), chromium (Cr), titanium (Ti), tantalum (Ta), tungsten (W), and copper (Cu). The first conductive layer GAT may have a single film structure or a multi-layered film structure.

The second insulating layer (or an interlayer insulating layer) INS2 may be disposed on the first conductive layer GAT. The second insulating layer INS2 may be disposed over a surface (e.g., may be generally disposed over an entire surface) of the base layer SUB. The second insulating layer INS2 may insulate the first conductive layer GAT and the second conductive layer SD from each other, and may include (e.g., may be) an interlayer insulating film.

The second insulating layer INS2 may include an inorganic insulating material or an organic insulating material. The second insulating layer INS2 may be a single film, or a multi-layered film including (e.g., formed of) a plurality of stacked films of different materials.

The second conductive layer SD may be disposed on the second insulating layer INS2. The second conductive layer SD may include the source electrode (e.g., a first transistor electrode) SE, the drain electrode (e.g., a second transistor electrode) DE, and the data line DL.

The source electrode SE and the drain electrode DE may be in contact with the source region and the drain region of the semiconductor pattern, respectively, through contact holes that extend (e.g., that pass) through the second insulating layer INS2 and the first insulating layer INS1.

Similar to the first conductive layer GAT, the second conductive layer SD may include one or more metals selected from, for example, molybdenum (Mo), aluminum (Al), platinum (Pt), palladium (Pd), silver (Ag), magnesium (Mg), gold (Au), nickel (Ni), neodymium (Nd), iridium (Ir), chromium (Cr), titanium (Ti), tantalum (Ta), tungsten (W), and copper (Cu). The second conductive layer SD may have a single film structure or a multi-layered film structure.

The third insulating layer (or a protective layer) INS3 may be positioned on the second conductive layer SD.

The light emitting element layer LDL may be disposed on the pixel circuit layer PCL. The light emitting element layer LDL may include at least one light emitting element EL and an encapsulation layer TFE provided at (e.g., in or on) the display area DA and connected to at least one transistor TR.

The light emitting element EL may be disposed on the third insulating layer INS3.

The light emitting element EL (or the light emitting element layer LDL) may include a first electrode (or a lower electrode) LE, a second electrode (or an upper electrode) UE, and a light emission layer (or an intermediate layer) IL. In addition, the light emitting element EL (or the light emitting element layer LDL) may further include a pixel defining film PDL. One of the first electrode LE and the second electrode UE may be an anode electrode, and the other one of the first electrode LE and the second electrode UE may be a cathode electrode. For example, the first electrode LE may be the anode electrode and the second electrode UE may be the cathode electrode.

The first electrode LE may be electrically connected to the drain electrode DE of the transistor TR through a contact hole extending (e.g., passing) through the third insulating layer INS3.

The pixel defining film PDL may be disposed along an edge (e.g., along edges) of the first electrode LE, and the pixel defining film PDL may include an organic insulating material. For example, the pixel defining film PDL may be disposed on the first electrode LE, and may have an opening that exposes at least a portion (e.g., a surface portion between the edges) of the first electrode LE.

The light emission layer IL may be disposed on the first electrode LE exposed by the pixel defining film PDL. The light emission layer IL may include a low molecular material or a high molecular material.

The second electrode UE may be disposed on the light emission layer IL. The second electrode UE may be a common electrode formed entirely on the light emission layer IL and the pixel defining film PDL. The second electrode UE may be a transparent electrode or a translucent electrode.

The encapsulation layer TFE may be disposed on the second electrode UE. The encapsulation layer TFE may prevent or substantially prevent moisture, air, and/or the like, which may be introduced from the outside, from penetrating into the light emitting element EL. The encapsulation layer TFE may include (e.g., may be formed of) a thin film encapsulation structure, and may include one or more organic films and one or more inorganic films.

While FIG. 15 shows that the light emitting element layer LDL includes an organic light emitting element, the present disclosure is not limited thereto. For example, in another embodiment, the light emitting element layer LDL may include any suitable kind of light emitting element, such as an inorganic light emitting element and/or the like.

The touch sensing layer TSP may be disposed on the light emitting element layer LDL. The touch sensing layer TSP may include the touch electrode TE provided at (e.g., in or on) the display area DA (or at the sensing area SA).

The touch sensing layer TSP may include a third conductive layer YTML1, a fourth insulating layer INS4, a fourth conductive layer YTML2, and a fifth insulating layer INS5.

The third conductive layer YTML1 may be disposed on the encapsulation layer TFE, and may include the first connection pattern CNP1.

The fourth insulating layer INS4 may be disposed on the third conductive layer YTML1. In addition, the fourth insulating layer INS4 may be disposed on the third conductive layer YTML1, and on the encapsulation layer TFE that is partially exposed by the third conductive layer YTML1.

The fourth conductive layer YTML2 may be disposed on the fourth insulating layer INS4, and may include the first touch electrode TE1, the second connection pattern CNP2, and the second touch electrode TE2 (e.g., refer to FIG. 14). The first touch electrode TE1 may be in contact with, or may be connected to, the first connection pattern CNP1 through a contact hole that extends (e.g., that passes) through the fourth insulating layer INS4.

The fifth insulating layer INS5 may be disposed on the fourth conductive layer YTML2, and may be disposed over a surface (e.g., over an entire surface) of the encapsulation layer TFE.

A second parasitic capacitor Cpar2 may be formed between the data line DL and the touch electrode TE (e.g., TE1 in FIG. 15). For example, the data line DL, the touch electrode TE (e.g., TE1 in FIG. 15) overlapping with the data line DL, and at least one insulating layer (e.g., the third insulating layer INS3, the pixel defining film PDL, and/or the like) that is disposed between the data line DL and the touch electrode TE may configure (e.g., may form) the second parasitic capacitor Cpar2.

As described above with reference to FIG. 5, when noise occurs in the data line DL (or in the data signal transmitted through the data line DL) through the output buffer 370 (e.g., refer to FIG. 3) by an operation of the chopping controller 320 (e.g., refer to FIG. 3) of the source driver 130, the second parasitic capacitor Cpar2 may affect the touch electrode TE (or a driving signal and/or a sensing signal flowing through the touch electrode TE), or may correspond to (e.g., may act as) touch noise.

The touch sensing layer TSP may be driven independently (e.g., separately) from the display layer DISP. For example, a period for scanning the touch sensing layer TSP (or time points at which a sensing signal is output) may not be synchronized with (e.g., may not correspond to) a driving period of the display layer DISP (or time points at which the chopping control signal is transmitted). In this case, it may be difficult to exclude (e.g., remove or ignore) the touch noise due to the noise of the data line DL.

According to various embodiments of the present disclosure, magnitude of the touch noise may be changed for each display device, and the touch noise may not occur according to a structure of the display layer DISP, a disposition of the data line DL at (e.g., in or on) the display layer DISP, a structure of the touch sensing layer TSP, a coupling structure of the touch sensing layer TSP to the display layer DISP, and/or the like.

Therefore, as described with reference to FIGS. 7 to 11, the display device 1 according to various embodiments of the present disclosure may include the chopping controller 320 capable of varying (or changing) the slew rate or the transition speed of the chopping control signal CCS during the manufacturing process of the display device 1, and the chopping controller 320 may operate based on the set slew rate (or the value of the set selection signal CHOP_SLOPE_CON[1:0]). For example, in various embodiments, the chopping controller 320 may set the slew rate (or a value of the selection signal CHOP_SLOPE_CON[1:0] (e.g., refer to FIG. 9) for determining the slew rate) of the chopping control signal CCS in consideration of whether or not the touch noise occurs, the magnitude of the touch noise, and/or the like. In various embodiments, the slew rate may be reduced as the touch noise is increased.

Figure 16:
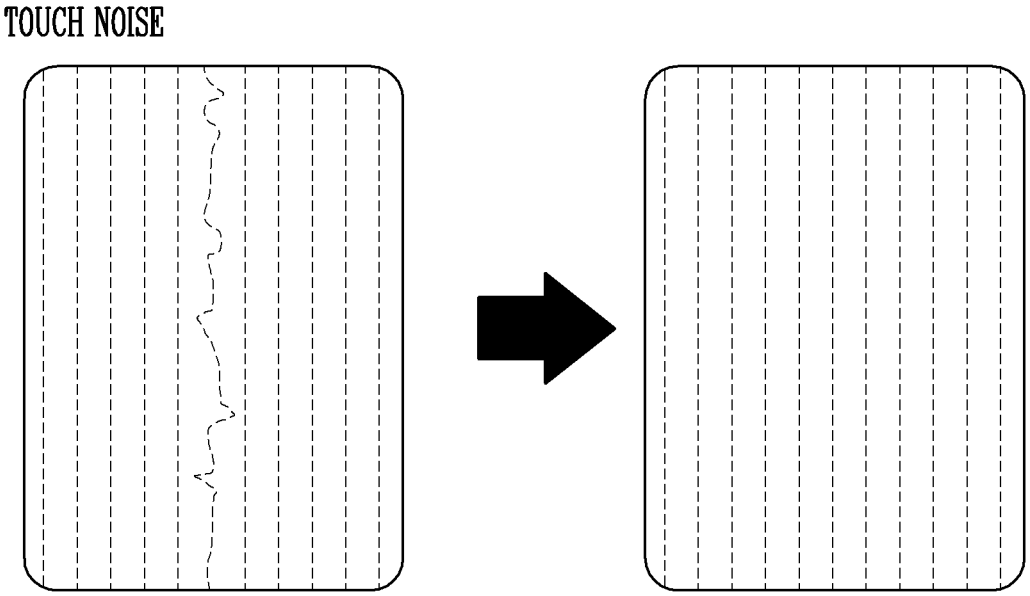
FIG. 16 is a diagram illustrating an example of a sensing signal that is measured by a touch sensing layer of FIG. 14.

FIG. 16 is a diagram illustrating an example of the sensing signal measured by the touch sensing layer of FIG. 14. FIG. 16 shows the sensing signal flowing through the touch electrode TE (e.g., the touch electrode columns configured of the second touch electrodes TE2) described with reference to FIG. 14. The sensing signal may be sequentially transmitted along the touch electrode columns.

Referring to FIGS. 15 and 16, when noise occurs in the data line DL by (e.g., due to) the operation of the chopping controller 320 of FIG. 7, touch noise may occur in the sensed signal that is output through the touch electrode column overlapping with the data line DL at a corresponding time point.

Therefore, the display device 1 according to various embodiments of the present disclosure may reduce or eliminate the touch noise by varying the slew rate or the transition speed of the chopping control signal CCS (e.g., refer to FIG. 7).

While one or more example embodiments of the present disclosure have been described with reference to the figures, it should be understood that the example embodiments described herein should be considered in a descriptive sense only and not for purposes of limitation. Accordingly, it will be understood by those having ordinary skill in the art that various modifications in form and details may be made therein without departing from the spirit and scope of the present disclosure as defined by the following claims, and their equivalents.

What is claimed is:

1. A source driver comprising:

a gamma voltage generator configured to generate gamma voltages having mutually different voltage levels;

a digital-to-analog converter configured to generate a data voltage corresponding to a grayscale value using the gamma voltages;

an output buffer unit configured to output the data voltage; and a chopping controller configured to generate a chopping control signal, and to provide the chopping control signal to the output buffer unit, wherein the output buffer unit comprises:

an amplifier connected to an output terminal of the digital-to-analog converter; and a chopping circuit configured to periodically change a polarity of an offset of the amplifier in response to the chopping control signal, and wherein the chopping controller is configured to change a slew rate of the chopping control signal.

2. The source driver according to claim 1, wherein the chopping circuit comprises:

a first switch connected between an input node and a first input terminal of the amplifier;

a second switch connected between the input node and a second input terminal of the amplifier;

a third switch connected between the first input terminal of the amplifier and an output terminal of the amplifier; and a fourth switch connected between the second input terminal of the amplifier and the output terminal of the amplifier, and wherein the first to fourth switches are configured to operate in response to the chopping control signal.

3. The source driver according to claim 2, wherein a parasitic capacitor is formed between an output node and a control line, the output node being connected to the output terminal of the amplifier, and the control line for transmitting the chopping control signal to the third switch.

4. The source driver according to claim 1, wherein the chopping controller comprises:

a logic control circuit configured to generate a first control signal including a pulse;

a level shifter configured to generate a second control signal by shifting up a level of the first control signal; and a buffer circuit configured to output the second control signal as the chopping control signal, and to change a buffer size.

5. The source driver according to claim 4, wherein the slew rate corresponds to a rate at which the chopping control signal follows the second control signal.

6. The source driver according to claim 4, wherein the buffer circuit comprises:

sub buffers connected to the chopping circuit in parallel; and sub switches connecting the sub buffers to an output terminal of the level shifter, respectively, and wherein at least one of the sub switches is configured to be turned on in response to a selection signal.

7. The source driver according to claim 6, wherein the sub buffers have the same buffer size as each other.

8. The source driver according to claim 6, wherein the sub buffers have mutually different buffer sizes from each other.

9. The source driver according to claim 4, wherein the slew rate of the chopping control signal is reduced as the buffer size of the buffer circuit is reduced.

10. The source driver according to claim 1, wherein the chopping controller comprises:

a logic control circuit configured to generate a first control signal having a square wave form;

a level shifter configured to generate a second control signal by shifting up a level of the first control signal;

a buffer circuit configured to output the second control signal as the chopping control signal; and an analog filter connected between an output terminal of the buffer circuit and the chopping circuit to variably filter a high frequency component of the chopping control signal.

11. The source driver according to claim 10, wherein the analog filter comprises:

a variable resistor connected between the buffer circuit and the chopping circuit; and a variable capacitor connected between the chopping circuit and a reference voltage line.

12. The source driver according to claim 1, wherein the chopping controller comprises:

a logic control circuit configured to generate a first control signal having a square wave form;

a level shifter configured to generate a second control signal by shifting up a level of the first control signal;

a buffer circuit configured to output the second control signal as the chopping control signal; and a delay element connected between an output terminal of the buffer circuit and the chopping circuit.

13. The source driver according to claim 12, wherein the delay element comprises:

a resistor connected between the buffer circuit and the chopping circuit; and a switch and a diode connected to the resistor in parallel, the switch and the diode being connected to each other in series.

14. A display device comprising:

a display panel comprising a data line, and a pixel connected to the data line; and a source driver configured to provide a data voltage to the data line, the source driver comprising:

a digital-to-analog converter configured to generate a data voltage;

an output buffer unit configured to output the data voltage to the data line; and a chopping controller configured to generate a chopping control signal, and to provide the chopping control signal to the output buffer unit, wherein the output buffer unit comprises:

an amplifier connected between the digital-to-analog converter and the data line; and a chopping circuit configured to periodically change a polarity of an offset of the amplifier in response to the chopping control signal, and wherein the chopping controller is configured to change a slew rate of the chopping control signal.

15. The display device according to claim 14, wherein the chopping circuit comprises:

a first switch connected between an input node and a first input terminal of the amplifier;

a second switch connected between the input node and a second input terminal of the amplifier;

a third switch connected between the first input terminal of the amplifier and an output terminal of the amplifier; and a fourth switch connected between the second input terminal of the amplifier and the output terminal of the amplifier, and wherein the first to fourth switches are configured to operate in response to the chopping control signal.

16. The display device according to claim 14, wherein the chopping controller comprises:

a logic control circuit configured to generate a first control signal including a pulse;

a level shifter configured to generate a second control signal by shifting up a level of the first control signal; and a buffer circuit configured to output the second control signal as the chopping control signal, and to change a buffer size.

17. The display device according to claim 16, further comprising:

a touch sensing unit comprising touch electrodes, wherein the buffer size of the buffer circuit is controlled according to noise of the touch electrodes due to the chopping control signal.

18. The display device according to claim 17, wherein the buffer size of the buffer circuit is reduced as the noise increases.

19. The display device according to claim 18, wherein the buffer size of the buffer circuit is set to be largest within a range at which the noise does not occur.

20. The display device according to claim 16, wherein the buffer circuit comprises:

sub buffers connected to the chopping circuit in parallel; and sub switches connecting the sub buffers to an output terminal of the level shifter, respectively, and wherein at least one of the sub switches is configured to be turned on in response to a selection signal.

* * * * *